US010446167B2

(12) United States Patent
Lindahl et al.

(10) Patent No.: US 10,446,167 B2
(45) Date of Patent: Oct. 15, 2019

(54) USER-SPECIFIC NOISE SUPPRESSION FOR VOICE QUALITY IMPROVEMENTS

(71) Applicant: Apple Inc., Cupertino, CA (US)

(72) Inventors: Aram Lindahl, Menlo Park, CA (US); Baptiste Pierre Paquier, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/165,523

(22) Filed: Jan. 27, 2014

(65) Prior Publication Data

US 2014/0142935 A1 May 22, 2014

Related U.S. Application Data

(63) Continuation of application No. 12/794,643, filed on Jun. 4, 2010, now Pat. No. 8,639,516.

(51) Int. Cl.
*G10L 21/00* (2013.01)
*G10L 21/0208* (2013.01)

(52) U.S. Cl.
CPC ..... *G10L 21/0208* (2013.01)

(58) Field of Classification Search
CPC ..... G10L 21/00
USPC ..... 704/275
See application file for complete search history.

(56) References Cited

U.S. PATENT DOCUMENTS 4,759,070 A 7/1988 Voroba et al.
4,974,191 A 11/1990 Amirghodsi et al.
5,128,672 A 7/1992 Kaehler
5,282,265 A 1/1994 Rohra Suda et al.
5,303,406 A 4/1994 Hansen et al.
5,386,556 A 1/1995 Hedin et al.
5,434,777 A 7/1995 Luciw
5,479,488 A 12/1995 Lenning et al.
5,577,241 A 11/1996 Spencer
5,608,624 A 3/1997 Luciw
5,682,539 A 10/1997 Conrad et al.
(Continued)

FOREIGN PATENT DOCUMENTS

CN 1640191 A 7/2005
DE 198 41 541 B4 12/2007
(Continued)

OTHER PUBLICATIONS

Alfred App, 2011, http://www.alfredapp.com/, 5 pages.
(Continued)

*Primary Examiner* — Michael N Opsasnick
(74) *Attorney, Agent, or Firm* — Dentons US LLP

(57) ABSTRACT

Systems, methods, and devices for user-specific noise suppression are provided. For example, when a voice-related feature of an electronic device is in use, the electronic device may receive an audio signal that includes a user voice. Since noise, such as ambient sounds, also may be received by the electronic device at this time, the electronic device may suppress such noise in the audio signal. In particular, the electronic device may suppress the noise in the audio signal while substantially preserving the user voice via user-specific noise suppression parameters. These user-specific noise suppression parameters may be based at least in part on a user noise suppression preference or a user voice profile, or a combination thereof.

39 Claims, 20 Drawing Sheets

(56) References Cited

U.S. PATENT DOCUMENTS 5,727,950 A 3/1998 Cook et al.
5,748,974 A 5/1998 Johnson
5,794,050 A 8/1998 Dahlgren et al.
5,826,261 A 10/1998 Spencer
5,895,466 A 4/1999 Goldberg et al.
5,899,972 A 5/1999 Miyazawa et al.
5,915,249 A 6/1999 Spencer
5,970,446 A * 10/1999 Goldberg ..... G10L 15/20 704/233
5,987,404 A 11/1999 Della Pietra et al.
6,052,656 A 4/2000 Suda et al.
6,081,750 A 6/2000 Hoffberg et al.
6,088,731 A 7/2000 Kiraly et al.
6,144,938 A 11/2000 Surace et al.
6,188,999 B1 2/2001 Moody
6,233,559 B1 5/2001 Balakrishnan
6,246,981 B1 6/2001 Papineni et al.
6,317,594 B1 11/2001 Gossman et al.
6,317,831 B1 11/2001 King
6,321,092 B1 11/2001 Fitch et al.
6,334,103 B1 12/2001 Surace et al.
6,421,672 B1 7/2002 McAllister et al.
6,434,524 B1 8/2002 Weber
6,446,076 B1 9/2002 Burkey et al.
6,453,292 B2 9/2002 Ramaswamy et al.
6,463,128 B1 10/2002 Elwin
6,466,654 B1 10/2002 Cooper et al.
6,499,013 B1 12/2002 Weber
6,501,937 B1 12/2002 Ho et al.
6,513,063 B1 1/2003 Julia et al.
6,523,061 B1 2/2003 Halverson et al.
6,526,395 B1 2/2003 Morris
6,532,444 B1 3/2003 Weber
6,532,446 B1 3/2003 King
6,598,039 B1 7/2003 Livowsky
6,601,026 B2 7/2003 Appelt et al.
6,604,059 B2 8/2003 Strubbe et al.
6,606,388 B1 8/2003 Townsend et al.
6,615,172 B1 9/2003 Bennett et al.
6,633,846 B1 10/2003 Bennett et al.
6,647,260 B2 11/2003 Dusse et al.
6,650,735 B2 11/2003 Burton et al.
6,665,639 B2 12/2003 Mozer et al.
6,665,640 B1 12/2003 Bennett et al.
6,691,111 B2 2/2004 Lazaridis et al.
6,691,151 B1 2/2004 Cheyer et al.
6,735,632 B1 5/2004 Kiraly et al.
6,742,021 B1 5/2004 Halverson et al.
6,757,362 B1 6/2004 Cooper et al.
6,757,718 B1 6/2004 Halverson et al.
6,778,951 B1 8/2004 Contractor
6,792,082 B1 9/2004 Levine
6,807,574 B1 10/2004 Partovi et al.
6,810,379 B1 10/2004 Vermeulen et al.
6,813,491 B1 11/2004 McKinney
6,832,194 B1 12/2004 Mozer et al.
6,842,767 B1 1/2005 Partovi et al.
6,851,115 B1 2/2005 Cheyer et al.
6,859,931 B1 2/2005 Cheyer et al.
6,895,380 B2 5/2005 Sepe, Jr.
6,895,558 B1 5/2005 Loveland
6,928,614 B1 8/2005 Everhart
6,937,975 B1 8/2005 Elworthy
6,964,023 B2 11/2005 Maes et al.
6,980,949 B2 12/2005 Ford
6,985,865 B1 1/2006 Packingham et al.
6,996,531 B2 2/2006 Korall et al.
6,999,927 B2 2/2006 Mozer et al.
7,020,685 B1 3/2006 Chen et al.
7,027,974 B1 4/2006 Busch et al.
7,036,128 B1 4/2006 Julia et al.
7,050,977 B1 5/2006 Bennett
7,062,428 B2 6/2006 Hogenhout et al.
7,069,560 B1 6/2006 Cheyer et al.
7,092,887 B2 8/2006 Mozer et al.
7,092,928 B1 8/2006 Elad et al.
7,127,046 B1 10/2006 Smith et al.
7,136,710 B1 11/2006 Hoffberg et al.
7,137,126 B1 11/2006 Coffman et al.
7,139,714 B2 11/2006 Bennett et al.
7,139,722 B2 11/2006 Perrella et al.
7,177,798 B2 2/2007 Hsu et al.
7,197,460 B1 3/2007 Gupta et al.
7,200,559 B2 4/2007 Wang
7,203,646 B2 4/2007 Bennett
7,216,073 B2 5/2007 Lavi et al.
7,216,080 B2 5/2007 Tsiao et al.
7,225,125 B2 5/2007 Bennett et al.
7,233,790 B2 6/2007 Kjellberg et al.
7,233,904 B2 6/2007 Luisi
7,266,496 B2 9/2007 Wang et al.
7,277,854 B2 10/2007 Bennett et al.
7,290,039 B1 10/2007 Lisitsa et al.
7,299,033 B2 11/2007 Kjellberg et al.
7,310,600 B1 12/2007 Garner et al.
7,324,947 B2 1/2008 Jordan et al.
7,349,953 B2 3/2008 Lisitsa et al.
7,376,556 B2 5/2008 Bennett
7,376,645 B2 5/2008 Bernard
7,379,874 B2 5/2008 Schmid et al.
7,386,449 B2 6/2008 Sun et al.
7,392,185 B2 6/2008 Bennett
7,398,209 B2 7/2008 Kennewick et al.
7,403,938 B2 7/2008 Harrison et al.
7,409,337 B1 8/2008 Potter et al.
7,415,100 B2 8/2008 Cooper et al.
7,418,392 B1 8/2008 Mozer et al.
7,426,467 B2 9/2008 Nashida et al.
7,447,635 B1 11/2008 Konopka et al.
7,454,351 B2 11/2008 Jeschke et al.
7,467,087 B1 12/2008 Gillick et al.
7,475,010 B2 1/2009 Chao
7,483,894 B2 1/2009 Cao
7,487,089 B2 2/2009 Mozer
7,496,498 B2 2/2009 Chu et al.
7,496,512 B2 2/2009 Zhao et al.
7,502,738 B2 3/2009 Kennewick et al.
7,508,373 B2 3/2009 Lin et al.
7,522,927 B2 4/2009 Fitch et al.
7,523,108 B2 4/2009 Cao
7,526,466 B2 4/2009 Au
7,529,671 B2 5/2009 Rockenbeck et al.
7,529,676 B2 5/2009 Koyama
7,536,565 B2 5/2009 Girish et al.
7,539,656 B2 5/2009 Fratkina et al.
7,546,382 B2 6/2009 Healey et al.
7,548,895 B2 6/2009 Pulsipher
7,555,431 B2 6/2009 Bennett
7,559,026 B2 7/2009 Girish et al.
7,571,106 B2 8/2009 Cao et al.
7,599,918 B2 10/2009 Shen et al.
7,613,264 B2 11/2009 Wells et al.
7,620,549 B2 11/2009 Di Cristo et al.
7,624,007 B2 11/2009 Bennett
7,627,461 B2 12/2009 Kuo et al.
7,627,481 B1 12/2009 Kuo et al.
7,634,409 B2 12/2009 Kennewick et al.
7,634,413 B1 12/2009 Kuo et al.
7,636,657 B2 12/2009 Ju et al.
7,640,160 B2 12/2009 Di Cristo et al.
7,647,225 B2 1/2010 Bennett et al.
7,657,424 B2 2/2010 Bennett
7,664,558 B2 2/2010 Lindahl et al.
7,672,841 B2 3/2010 Bennett
7,673,238 B2 3/2010 Girish et al.
7,676,026 B1 3/2010 Baxter, Jr.
7,684,985 B2 3/2010 Dominach et al.
7,693,715 B2 4/2010 Hwang et al.
7,693,720 B2 4/2010 Kennewick et al.
7,698,131 B2 4/2010 Bennett
7,702,500 B2 4/2010 Blaedow
7,702,508 B2 4/2010 Bennett
7,707,027 B2 4/2010 Balchandran et al.
7,707,032 B2 4/2010 Wang et al.

(56) References Cited

U.S. PATENT DOCUMENTS 7,707,267 B2 4/2010 Lisitsa et al.
7,711,129 B2 5/2010 Lindahl et al.
7,711,672 B2 5/2010 Au
7,716,056 B2 5/2010 Weng et al.
7,720,674 B2 5/2010 Kaiser et al.
7,720,683 B1 5/2010 Vermeulen et al.
7,725,307 B2 5/2010 Bennett
7,725,318 B2 5/2010 Gavalda et al.
7,725,320 B2 5/2010 Bennett
7,725,321 B2 5/2010 Bennett
7,729,904 B2 6/2010 Bennett
7,729,916 B2 6/2010 Coffman et al.
7,734,461 B2 6/2010 Kwak et al.
7,752,152 B2 7/2010 Paek et al.
7,774,204 B2 8/2010 Mozer et al.
7,783,486 B2 8/2010 Rosser et al.
7,801,729 B2 9/2010 Mozer
7,809,570 B2 10/2010 Kennewick et al.
7,809,610 B2 10/2010 Cao
7,818,176 B2 10/2010 Freeman et al.
7,822,608 B2 10/2010 Cross, Jr. et al.
7,826,945 B2 11/2010 Zhang et al.
7,831,426 B2 11/2010 Bennett
7,840,400 B2 11/2010 Lavi et al.
7,840,447 B2 11/2010 Kleinrock et al.
7,873,519 B2 1/2011 Bennett
7,873,654 B2 1/2011 Bernard
7,881,936 B2 2/2011 Longé et al.
7,912,702 B2 3/2011 Bennett
7,917,367 B2 3/2011 Di Cristo et al.
7,917,497 B2 3/2011 Harrison et al.
7,920,678 B2 4/2011 Cooper et al.
7,925,525 B2 4/2011 Chin
7,930,168 B2 4/2011 Weng et al.
7,949,529 B2 5/2011 Weider et al.
7,974,844 B2 7/2011 Sumita
7,974,972 B2 7/2011 Cao
7,983,915 B2 7/2011 Knight et al.
7,983,917 B2 7/2011 Kennewick et al.
7,983,997 B2 7/2011 Allen et al.
7,987,151 B2 7/2011 Schott et al.
8,000,453 B2 8/2011 Cooper et al.
8,005,679 B2 8/2011 Jordan et al.
8,015,006 B2 9/2011 Kennewick et al.
8,024,195 B2 9/2011 Mozer et al.
8,036,901 B2 10/2011 Mozer
8,041,570 B2 10/2011 Mirkovic et al.
8,041,611 B2 10/2011 Kleinrock et al.
8,055,708 B2 11/2011 Chitsaz et al.
8,069,046 B2 11/2011 Kennewick et al.
8,073,681 B2 12/2011 Baldwin et al.
8,082,153 B2 12/2011 Coffman et al.
8,095,364 B2 1/2012 Longé et al.
8,099,289 B2 1/2012 Mozer et al.
8,107,401 B2 1/2012 John et al.
8,112,275 B2 2/2012 Kennewick et al.
8,112,280 B2 2/2012 Lu
8,140,335 B2 3/2012 Kennewick et al.
8,165,886 B1 4/2012 Gagnon et al.
8,166,019 B1 4/2012 Lee et al.
8,190,359 B2 5/2012 Bourne
8,195,467 B2 6/2012 Mozer et al.
8,204,238 B2 6/2012 Mozer
8,219,407 B1 7/2012 Roy et al.
8,234,111 B2* 7/2012 Lloyd ..... G10L 15/20 704/231
8,639,516 B2 1/2014 Lindahl et al.
2002/0032751 A1* 3/2002 Bharadwaj ..... 709/218
2002/0049587 A1* 4/2002 Miyazawa ..... G10L 15/20 704/233
2002/0059068 A1* 5/2002 Rose ..... G10L 15/08 704/246
2002/0069063 A1 6/2002 Buchner et al.
2002/0072816 A1* 6/2002 Shdema et al. ..... 700/94
2003/0016770 A1* 1/2003 Trans et al. ..... 375/346
2003/0033153 A1 2/2003 Olson et al.
2003/0046401 A1* 3/2003 Abbott et al. ..... 709/228
2004/0122664 A1* 6/2004 Lorenzo et al. ..... 704/226
2004/0135701 A1 7/2004 Yasuda et al.
2004/0213419 A1* 10/2004 Varma et al. ..... 381/92
2004/0257432 A1 12/2004 Girish et al.
2005/0071332 A1 3/2005 Ortega et al.
2005/0080625 A1 4/2005 Bennett et al.
2005/0119897 A1 6/2005 Bennett et al.
2005/0143972 A1 6/2005 Gopalakrishnan et al.
2005/0201572 A1 9/2005 Lindahl et al.
2006/0018492 A1 1/2006 Chiu et al.
2006/0053014 A1* 3/2006 Yoshizawa ..... G10L 15/06 704/256.4
2006/0067535 A1 3/2006 Culbert et al.
2006/0067536 A1 3/2006 Culbert et al.
2006/0116874 A1 6/2006 Samuelson et al.
2006/0122834 A1 6/2006 Bennett
2006/0143007 A1 6/2006 Koh et al.
2006/0153040 A1 7/2006 Girish et al.
2006/0200253 A1* 9/2006 Hoffberg et al. ..... 700/19
2006/0221738 A1 10/2006 Lindahl et al.
2006/0221788 A1 10/2006 Lindahl et al.
2006/0239471 A1* 10/2006 Mao et al. ..... 381/92
2006/0274905 A1 12/2006 Lindahl et al.
2006/0282264 A1* 12/2006 Denny et al. ..... 704/233
2007/0047719 A1* 3/2007 Dhawan et al. ..... 379/235
2007/0055508 A1* 3/2007 Zhao ..... H04R 25/55 704/226
2007/0055529 A1 3/2007 Kanevsky et al.
2007/0058832 A1 3/2007 Hug et al.
2007/0083467 A1 4/2007 Lindahl et al.
2007/0088556 A1 4/2007 Andrew
2007/0100790 A1 5/2007 Cheyer et al.
2007/0118377 A1 5/2007 Badino et al.
2007/0157268 A1 7/2007 Girish et al.
2007/0174188 A1 7/2007 Fish
2007/0185917 A1 8/2007 Prahlad et al.
2007/0282595 A1 12/2007 Tunning et al.
2007/0291108 A1* 12/2007 Huber et al. ..... 348/14.02
2007/0294263 A1* 12/2007 Punj et al. ..... 707/10
2008/0015864 A1 1/2008 Ross et al.
2008/0021708 A1 1/2008 Bennett et al.
2008/0034032 A1 2/2008 Healey et al.
2008/0052063 A1 2/2008 Bennett et al.
2008/0075296 A1 3/2008 Lindahl et al.
2008/0120112 A1 5/2008 Jordan et al.
2008/0129520 A1 6/2008 Lee
2008/0140657 A1 6/2008 Azvine et al.
2008/0157867 A1 7/2008 Krah
2008/0165980 A1 7/2008 Pavlovic et al.
2008/0221903 A1 9/2008 Kanevsky et al.
2008/0228496 A1 9/2008 Yu et al.
2008/0247519 A1 10/2008 Abella et al.
2008/0249770 A1 10/2008 Kim et al.
2008/0253577 A1 10/2008 Eppolito
2008/0300878 A1 12/2008 Bennett
2009/0003115 A1 1/2009 Lindahl et al.
2009/0005891 A1 1/2009 Batson et al.
2009/0006100 A1 1/2009 Badger et al.
2009/0006343 A1 1/2009 Platt et al.
2009/0006488 A1 1/2009 Lindahl et al.
2009/0006671 A1 1/2009 Batson et al.
2009/0022329 A1 1/2009 Mahowald
2009/0030800 A1 1/2009 Grois
2009/0058823 A1 3/2009 Kocienda
2009/0060472 A1 3/2009 Bull et al.
2009/0076796 A1 3/2009 Daraselia
2009/0083047 A1 3/2009 Lindahl et al.
2009/0092261 A1 4/2009 Bard
2009/0092262 A1 4/2009 Costa et al.
2009/0100049 A1 4/2009 Cao
2009/0112677 A1 4/2009 Rhett
2009/0144036 A1* 6/2009 Jorgensen ..... H04R 29/001 703/6
2009/0150156 A1 6/2009 Kennewick et al.
2009/0157401 A1 6/2009 Bennett
2009/0164441 A1 6/2009 Cheyer
2009/0167508 A1 7/2009 Fadell et al.

(56) References Cited

U.S. PATENT DOCUMENTS

2009/0167509 A1 7/2009 Fadell et al.
2009/0171664 A1 7/2009 Kennewick et al.
2009/0172542 A1 7/2009 Girish et al.
2009/0182445 A1 7/2009 Girish et al.
2009/0252350 A1 10/2009 Seguin
2009/0253457 A1 10/2009 Seguin
2009/0254339 A1 10/2009 Seguin
2009/0271188 A1* 10/2009 Agapi ..... G10L 21/0208 704/233
2009/0271189 A1* 10/2009 Agapi ..... G10L 15/01 704/233
2009/0290718 A1 11/2009 Kahn et al.
2009/0299745 A1 12/2009 Kennewick et al.
2009/0299849 A1 12/2009 Cao et al.
2010/0005081 A1 1/2010 Bennett
2010/0023320 A1 1/2010 Di Cristo et al.
2010/0030928 A1 2/2010 Conroy et al.
2010/0036660 A1 2/2010 Bennett
2010/0042400 A1 2/2010 Block et al.
2010/0060646 A1 3/2010 Unsal et al.
2010/0063825 A1 3/2010 Williams et al.
2010/0064113 A1 3/2010 Lindahl et al.
2010/0081487 A1 4/2010 Chen et al.
2010/0082970 A1 4/2010 Lindahl et al.
2010/0088020 A1 4/2010 Sano et al.
2010/0100212 A1 4/2010 Lindahl et al.
2010/0145700 A1 6/2010 Kennewick et al.
2010/0204986 A1 8/2010 Kennewick et al.
2010/0217604 A1 8/2010 Baldwin et al.
2010/0228540 A1 9/2010 Bennett
2010/0235341 A1 9/2010 Bennett
2010/0257160 A1 10/2010 Cao
2010/0277579 A1 11/2010 Cho et al.
2010/0280983 A1 11/2010 Cho et al.
2010/0286985 A1 11/2010 Kennewick et al.
2010/0299142 A1 11/2010 Freeman et al.
2010/0312547 A1 12/2010 van Os et al.
2010/0318576 A1 12/2010 Kim
2010/0332235 A1 12/2010 David
2010/0332348 A1 12/2010 Cao
2011/0060807 A1 3/2011 Martin et al.
2011/0082688 A1 4/2011 Kim et al.
2011/0112827 A1 5/2011 Kennewick et al.
2011/0112921 A1 5/2011 Kennewick et al.
2011/0119049 A1 5/2011 Ylonen
2011/0125540 A1 5/2011 Jang et al.
2011/0130958 A1 6/2011 Stahl et al.
2011/0131036 A1 6/2011 Di Cristo et al.
2011/0131045 A1 6/2011 Cristo et al.
2011/0144999 A1 6/2011 Jang et al.
2011/0161076 A1 6/2011 Davis et al.
2011/0175810 A1 7/2011 Markovic et al.
2011/0184730 A1 7/2011 LeBeau et al.
2011/0218855 A1 9/2011 Cao et al.
2011/0231182 A1 9/2011 Weider et al.
2011/0231188 A1 9/2011 Kennewick et al.
2011/0264643 A1 10/2011 Cao
2011/0279368 A1 11/2011 Klein et al.
2011/0306426 A1 12/2011 Novak et al.
2012/0002820 A1 1/2012 Leichter
2012/0016678 A1 1/2012 Gruber et al.
2012/0020490 A1 1/2012 Leichter
2012/0022787 A1 1/2012 LeBeau et al.
2012/0022857 A1 1/2012 Baldwin et al.
2012/0022860 A1 1/2012 Lloyd et al.
2012/0022868 A1 1/2012 LeBeau et al.
2012/0022869 A1 1/2012 Lloyd et al.
2012/0022870 A1 1/2012 Kristjansson et al.
2012/0022874 A1 1/2012 Lloyd et al.
2012/0022876 A1 1/2012 Lebeau et al.
2012/0023088 A1 1/2012 Cheng et al.
2012/0034904 A1 2/2012 LeBeau et al.
2012/0035908 A1 2/2012 LeBeau et al.
2012/0035924 A1 2/2012 Jitkoff et al.
2012/0035931 A1 2/2012 LeBeau et al.
2012/0035932 A1 2/2012 Jitkoff et al.
2012/0042343 A1 2/2012 Laligand et al.
2012/0271676 A1 10/2012 Aravamudan et al.

FOREIGN PATENT DOCUMENTS

EP 0558312 A1 9/1993
EP 1245023 A1 10/2002
JP 01-500631 A 3/1989
JP 06 019965 1/1994
JP 2001 125896 5/2001
JP 2002 024212 1/2002
JP 2003 517158 A 5/2003
JP 2008-236448 A 10/2008
JP 2008-271481 A 11/2008
JP 2009 036999 2/2009
KR 10-0776800 B1 11/2007
KR 10-0810500 B1 3/2008
KR 10 2008 109322 A 12/2008
KR 10 2009 086805 A 8/2009
KR 10-0920267 B1 10/2009
KR 10 2011 0113414 A 10/2011
WO 97/10586 A1 3/1997
WO 2004/008801 A1 1/2004
WO WO 20040008801 A1 1/2004
WO WO 2006/129967 A1 12/2006
WO WO 2011/088053 A2 7/2011

OTHER PUBLICATIONS

Ambite, JL., et al., "Design and Implementation of the CALO Query Manager," Copyright © 2006, American Association for Artificial Intelligence, (www.aaai.org), 8 pages.

Ambite, JL., et al., "Integration of Heterogeneous Knowledge Sources in the CALO Query Manager," 2005, The 4th International Conference on Ontologies, DataBases, and Applications of Semantics (ODBASE), Agia Napa, Cyprus, ttp://www.isi.edu/people/ambite/publications/integration_heterogeneous_knowledge_sources_calo_query_manager, 18 pages.

Belvin, R. et al., "Development of the HRL Route Navigation Dialogue System," 2001, In Proceedings of the First International Conference on Human Language Technology Research, Paper, Copyright © 2001 HRL Laboratories, LLC, http://citeseerx.ist.psu.edu/viewdoc/summary?doi=10.1.1.10.6538, 5 pages.

Berry, P. M., et al. "PTIME: Personalized Assistance for Calendaring," ACM Transactions on Intelligent Systems and Technology, vol. 2, No. 4, Article 40, Publication date: Jul. 2011, 40:1-22, 22 pages.

Bussler, C., et al., "Web Service Execution Environment (WSMX)," Jun. 3, 2005, W3C Member Submission, http://www.w3.org/Submission/WSMX, 29 pages.

Butcher, M., "EVI arrives in town to go toe-to-toe with Siri," Jan. 23, 2012, http://techcrunch.com/2012/01/23/evi-arrives-in-town-to-go-toe-to-toe-with-siri/, 2 pages.

Chen, Y., "Multimedia Siri Finds and Plays Whatever You Ask for," Feb. 9, 2012, http://www.psfk.conn/2012/02/multimedia-siri.htnnl, 9 pages.

Cheyer, A., "About Adam Cheyer," Sep. 17, 2012, http://www.adam.cheyer.com/about.html, 2 pages.

Cheyer, A., "A Perspective on AI & Agent Technologies for SCM," VerticalNet, 2001 presentation, 22 pages.

Cheyer, A. et al., "Spoken Language and Multimodal Applications for Electronic Realties," © Springer-Verlag London Ltd, Virtual Reality 1999, 3:1-15, 15 pages.

Cutkosky, M. R. et al., "PACT: An Experiment in Integrating Concurrent Engineering Systems," Journal, Computer, vol. 26 Issue 1, Jan. 1993, IEEE Computer Society Press Los Alamitos, CA, USA, http://dl.acm.org/citation.cfm?id=165320, 14 pages.

Domingue, J., et al., "Web Service Modeling Ontology (WSMO)—An Ontology for Semantic Web Services," Jun. 9-10, 2005, position paper at the W3C Workshop on Frameworks for Semantics in Web Services, Innsbruck, Austria, 6 pages.

(56) References Cited

OTHER PUBLICATIONS

Elio, R. et al., "On Abstract Task Models and Conversation Policies," May 1999, http://webdocs.cs.ualberta.ca/~ree/publications/papers2/ATS.AA99.pdf, 10 pages.
Ericsson, S. et al., "Software illustrating a unified approach to multimodality and multilinguality in the in-home domain," Dec. 22, 2006, Talk and Look: Tools for Ambient Linguistic Knowledge, http://www.talk-project.eurice.eu/fileadmin/talk/publications_public/deliverables_public/D1_6.pdf, 127 pages.
Evi, "Meet Evi: the one mobile app that provides solutions for your everyday problems," Feb. 8, 2012, http://www.evi.com/, 3 pages.
Feigenbaum, E., et al., "Computer-assisted Semantic Annotation of Scientific Life Works," 2007, http://tomgruber.org/writing/stanford-cs300.pdf, 22 pages.
Gannes, L., "Alfred App Gives Personalized Restaurant Recommendations," allthingsd.com, Jul. 18, 2011, http://allthingsd.com/20110718/alfred-app-gives-personalized-restaurant-recommendations/, 3 pages.
Gautier, P. O., et al. "Generating Explanations of Device Behavior Using Compositional Modeling and Causal Ordering," 1993, http://citeseerx.ist.psu.edu/viewdoc/summary?doi=10.1.1.42.8394, 9 pages.
Gervasio, M. T., et al., Active Preference Learning for Personalized Calendar Scheduling Assistancae, Copyright © 2005, http://www.ai.sri.com/~gervasio/pubs/gervasio-iui05.pdf, 8 pages.
Glass, A., "Explaining Preference Learning," 2006, http://cs229.stanford.edu/proj2006/Glass-ExplainingPreferenceLearning.pdf, 5 pages.
Glass, J., et al., "Multilingual Spoken-Language Understanding in the MIT Voyager System," Aug. 1995, http://groups.csail.mit.edu/sls/publications/1995/speechcomm95-voyager.pdf, 29 pages.
Goddeau, D., et al., "A Form-Based Dialogue Manager for Spoken Language Applications," Oct. 1996, http://phasedance.com/pdf/icslp96.pdf, 4 pages.
Goddeau, D., et al., "Galaxy: A Human-Language Interface to On-Line Travel Information," 1994 International Conference on Spoken Language Processing, Sep. 18-22, 1994, Pacific Convention Plaza Yokohama, Japan, 6 pages.
Gruber, T. R., et al., "An Ontology for Engineering Mathematics," In Jon Doyle, Piero Torasso, & Erik Sandewall, Eds., Fourth International Conference on Principles of Knowledge Representation and Reasoning, Gustav Stresemann Institut, Bonn, Germany, Morgan Kaufmann, 1994, http://www-ksl.stanford.edu/knowledge-sharing/papers/engmath.html, 22 pages.
Gruber, T. R., "A Translation Approach to Portable Ontology Specifications," Knowledge Systems Laboratory, Stanford University, Sep. 1992, Technical Report KSL 92-71, Revised Apr. 1993, 27 pages.
Gruber, T. R., "Automated Knowledge Acquisition for Strategic Knowledge," Knowledge Systems Laboratory, Machine Learning, 4, 293-336 (1989), 44 pages.
Gruber, T. R., "(Avoiding) the Travesty of the Commons," Presentation at NPUC 2006, New Paradigms for User Computing, IBM Almaden Research Center, Jul. 24, 2006. http://tomgruber.org/writing/avoiding-travestry.htm, 52 pages.
Gruber, T. R., "Big Think Small Screen: How semantic computing in the cloud will revolutionize the consumer experience on the phone," Keynote presentation at Web 3.0 conference, Jan. 27, 2010, http://tomgruber.org/writing/web30jan2010.htm, 41 pages.
Gruber, T. R., "Collaborating around Shared Content on the WWW," W3C Workshop on WWW and Collaboration, Cambridge, MA, Sep. 11, 1995, http://www.w3.org/Collaboration/Workshop/Proceedings/P9.html, 1 page.
Gruber, T. R., "Collective Knowledge Systems: Where the Social Web meets the Semantic Web," Web Semantics: Science, Services and Agents on the World Wide Web (2007), doi:10.1016/j.websem.2007.11.011, keynote presentation given at the 5th International Semantic Web Conference, Nov. 7, 2006, 19 pages.
Gruber, T. R., "Despite our Best Efforts, Ontologies are not the Problem," AAAI Spring Symposium, Mar. 2008, http://tomgruber.org/writing/aaai-ss08.htm, 40 pages.
Gruber, T. R., "Enterprise Collaboration Management with Intraspect," Intraspect Software, Inc., Instraspect Technical White Paper Jul. 2001, 24 pages.
Gruber, T. R., "Every ontology is a treaty—a social agreement—among people with some common motive in sharing," Interview by Dr. Miltiadis D. Lytras, Official Quarterly Bulletin of AIS Special Interest Group on Semantic Web and Information Systems, vol. 1, Issue 3, 2004, http://www.sigsemis.org 1, 5 pages.
Gruber, T. R., et al., "Generative Design Rationale: Beyond the Record and Replay Paradigm," Knowledge Systems Laboratory, Stanford University, Dec. 1991, Technical Report KSL 92-59, Updated Feb. 1993, 24 pages.
Gruber, T. R., "Helping Organizations Collaborate, Communicate, and Learn," Presentation to NASA Ames Research, Mountain View, CA, Mar. 2003, http://tomgruber.org/writing/organizational-intelligence-talk.htm, 30 pages.
Gruber, T. R., "Intelligence at the Interface: Semantic Technology and the Consumer Internet Experience," Presentation at Semantic Technologies conference (SemTech08), May 20, 2008, http://tomgruber.org/writing.htm, 40 pages.
Gruber, T. R., Interactive Acquisition of Justifications: Learning "Why" by Being Told "What" Knowledge Systems Laboratory, Stanford University, Oct. 1990, Technical Report KSL 91-17, Revised Feb. 1991, 24 pages.
Gruber, T. R., "It Is What It Does: The Pragmatics of Ontology for Knowledge Sharing," (c) 2000, 2003, http://www.cidoc-crm.org/docs/symposium_presentations/gruber_cidoc-ontology-2003.pdf, 21 pages.
Gruber, T. R., et al., "Machine-generated Explanations of Engineering Models: A Compositional Modeling Approach," (1993) In Proc. International Joint Conference on Artificial Intelligence, http://citeseerx.ist.psu.edu/viewdoc/summary?doi=10.1.1.34.930, 7 pages.
Gruber, T. R., "2021: Mass Collaboration and the Really New Economy," TNTY Futures, the newsletter of The Next Twenty Years series, vol. 1, Issue 6, Aug. 2001, http://www.tnty.corn/newsletter/futures/archive/v01-05business.html, 5 pages.
Gruber, T. R., et al.,"Nike: A National Infrastructure for Knowledge Exchange," Oct. 1994, http://www.eit.com/papers/nike/nike.html and nike.ps, 10 pages.
Gruber, T. R., "Ontologies, Web 2.0 and Beyond," Apr. 24, 2007, Ontology Summit 2007, http://tomgruber.org/writing/ontolog-social-web-keynote.pdf, 17 pages.
Gruber, T. R., "Ontology of Folksonomy: A Mash-up of Apples and Oranges," Originally published to the web in 2005, Int'l Journal on Semantic Web & Information Systems, 3(2), 2007, 7 pages.
Gruber, T. R., "Siri, a Virtual Personal Assistant—Bringing Intelligence to the Interface," Jun. 16, 2009, Keynote presentation at Semantic Technologies conference, Jun. 2009. http://tomgruber.org/writing/semtech09.htm, 22 pages.
Gruber, T. R., "TagOntology," Presentation to Tag Camp, www.tagcamp.org, Oct. 29, 2005, 20 pages.
Gruber, T. R., et al., "Toward a Knowledge Medium for Collaborative Product Development," In Artificial Intelligence in Design 1992, from Proceedings of the Second International Conference on Artificial Intelligence in Design, Pittsburgh, USA, Jun. 22-25, 1992, 19 pages.
Gruber, T. R., "Toward Principles for the Design of Ontologies Used for Knowledge Sharing," In International Journal Human-Computer Studies 43, p. 907-928, substantial revision of paper presented at the International Workshop on Formal Ontology, Mar. 1993, Padova, Italy, available as Technical Report KSL 93-04, Knowledge Systems Laboratory, Stanford University, further revised Aug. 23, 1993, 23 pages.
Gruber, T. R., "Where the Social Web meets the Semantic Web," Presentation at the 5th International Semantic Web Conference, Nov. 7, 2006, 38 pages.
Guzzoni, D., et al., "A Unified Platform for Building Intelligent Web Interaction Assistants," Proceedings of the 2006 IEEE/WIC/ACM International Conference on Web Intelligence and Intelligent Agent Technology, Computer Society, 4 pages.

(56) References Cited

OTHER PUBLICATIONS

Guzzoni, D., et al., "Modeling Human-Agent Interaction with Active Ontologies," 2007, AAAI Spring Symposium, Interaction Challenges for Intelligent Assistants, Stanford University, Palo Alto, California, 8 pages.
Guzzoni, D., et al., "Active, A Tool for Building Intelligent User Interfaces," ASC 2007, Palma de Mallorca, http://lsro.epfl.ch/page-34241.html, 6 pages.
Guzzoni, D., et al., "Active, A Platform for Building Intelligent Operating Rooms," Surgetica 2007 Computer-Aided Medical Interventions: tools and applications, pp. 191-198, Paris, 2007, Sauramps Médical, http://lsro.epfl.ch/page-68384-en.html, 8 pages.
Hardawar, D., "Driving app Waze builds its own Siri for hands-free voice control," Feb. 9, 2012, http://venturebeat.com/2012/02/09/driving-app-waze-builds-its-own-siri-for-hands-free-voice-control/, 4 pages.
Intraspect Software, "The Intraspect Knowledge Management Solution: Technical Overview," http://tomgruber.org/writing/intraspect-whitepaper-1998.pdf, 18 pages.
Julia, L., et al., Un éditeur interactif de tableaux dessinés à main levée (An Interactive Editor for Hand-Sketched Tables), Traitement du Signal 1995, vol. 12, No. 6, 8 pages. No English Translation Available.
Karp, P. D., "A Generic Knowledge-Base Access Protocol," May 12, 1994, http://lecture.cs.buu.ac.th/~f50353/Document/gfp.pdf, 66 pages.
Lemon, O., et al., "Multithreaded Context for Robust Conversational Interfaces: Context-Sensitive Speech Recognition and Interpretation of Corrective Fragments," Sep. 2004, ACM Transactions on Computer-Human Interaction, vol. 11, No. 3, 27 pages.
Leong, L., et al., "CASIS: A Context-Aware Speech Interface System," IUI'05, Jan. 9-12, 2005, Proceedings of the 10th international conference on Intelligent user interfaces, San Diego, California, USA, 8 pages.
Lieberman, H., et al., "Out of context: Computer systems that adapt to, and learn from, context," 2000, IBM Systems Journal, vol. 39, Nos. 3/4, 2000, 16 pages.
Lin, B., et al., "A Distributed Architecture for Cooperative Spoken Dialogue Agents with Coherent Dialogue State and History," 1999, http://citeseerx.ist.psu.edu/viewdoc/summary?doi=10.1.1.42.272, 4 pages.
Martin, D., et al., "The Open Agent Architecture: A Framework for building distributed software systems," Jan.-Mar. 1999, Applied Artificial Intelligence: An International Journal, vol. 13, No. 1-2, http://adam.cheyer.com/papers/oaa.pdf, 38 pages.
McGuire, J., et al., "SHADE: Technology for Knowledge-Based Collaborative Engineering," 1993, Journal of Concurrent Engineering: Applications and Research (CERA), 18 pages.
Meng, H., et al., "Wheels: A Conversational System in the Automobile Classified Domain," Oct. 1996, httphttp://citeseerxist.psu.edu/viewdoc/summary?doi=10.1.1.16.3022, 4 pages.
Milward, D., et al., "D2.2: Dynamic Multimodal Interface Reconfiguration," Talk and Look: Tools for Ambient Linguistic Knowledge, Aug. 8, 2006, http://www.ihmc.us/users/nblaylock/Pubs/Files/talk_d2.2.pdf, 69 pages.
Mitra, P., et al., "A Graph-Oriented Model for Articulation of Ontology Interdependencies," 2000, http://ilpubs.stanford.edu:8090/442//1/2000-20.pdf, 15 pages.
Moran, D. B., et al., "Multimodal User Interfaces in the Open Agent Architecture," Proc. of the 1997 International Conference on Intelligent User Interfaces (IU197), 8 pages.
Mozer, M., "An Intelligent Environment Must be Adaptive," Mar./Apr. 1999, IEEE Intelligent Systems, 3 pages.
Mühlhäuser, M., "Context Aware Voice User Interfaces for Workflow Support," Darmstadt 2007, http://tuprints.ulb.tu-darmstadt.de/876/1/PhD.pdf, 254 pages.
Naone, E., "TR10: Intelligent Software Assistant," Mar.-Apr. 2009, Technology Review, http://www.technologyreview.com/printer_friendly_article.aspx?id=22117, 2 pages.
Neches, R., "Enabling Technology for Knowledge Sharing," Fall 1991, AI Magazine, pp. 37-56, (21 pages).
Nöth, E., et al., "Verbmobil: The Use of Prosody in the Linguistic Components of a Speech Understanding System," IEEE Transactions on Speech and Audio Processing, vol. 8, No. 5, Sep. 2000, 14 pages.
*Phoenix Solutions, Inc.* v. *West Interactive Corp.*, Document 40, Declaration of Christopher Schmandt Regarding the MIT Galaxy System dated Jul. 2, 2010, 162 pages.
Rice, J., et al., "Monthly Program: Nov. 14, 1995," The San Francisco Bay Area Chapter of ACM SIGCHI, http://www.baychi.org/calendar/19951114/, 2 pages.
Rice, J., et al., "Using the Web Instead of a Window System," Knowledge Systems Laboratory, Stanford University, (http://tomgruber.org/writing/ks1-95-69.pdf, Sep. 1995.) CHI '96 Proceedings: Conference on Human Factors in Computing Systems, Apr. 13-18, 1996, Vancouver, BC, Canada, 14 pages.
Rivlin, Z., et al., "Maestro: Conductor of Multimedia Analysis Technologies," 1999 SRI International, Communications of the Association for Computing Machinery (CACM), 7 pages.
Roddy, D., et al., "Communication and Collaboration in a Landscape of B2B eMarketplaces," VerticalNet Solutions, white paper, Jun. 15, 2000, 23 pages.
Seneff, S., et al., "A New Restaurant Guide Conversational System: Issues in Rapid Prototyping for Specialized Domains," Oct. 1996, citeseerx.ist.psu.edu/viewdoc/download?doi=10.1.1.16...rep . . . , 4 pages.
Sheth, A., et al., "Relationships at the Heart of Semantic Web: Modeling, Discovering, and Exploiting Complex Semantic Relationships," Oct. 13, 2002, Enhancing the Power of the Internet: Studies in Fuzziness and Soft Computing, SpringerVerlag, 38 pages.
Simonite, T., "One Easy Way to Make Siri Smarter," Oct. 18, 2011, Technology Review, http:// www.technologyreview.com/printer_friendly_article.aspx?id=38915, 2 pages.
Stent, A., et al., "The CommandTalk Spoken Dialogue System," 1999, http://acl.ldc.upenn.edu/P/P99/P99-1024.pdf, 8 pages.
Tofel, K., et al., "SpeakTolt: A personal assistant for older iPhones, iPads," Feb. 9, 2012, http://gigaom.com/apple/speaktoit-siri-for-older-iphones-ipads/, 7 pages.
Tucker, J., "Too lazy to grab your TV remote? Use Siri instead," Nov. 30, 2011, http://www.engadget.com/2011/11/30/too-lazy-to-grab-your-tv-remote-use-siri-instead/, 8 pages.
Tur, G., et al., "The-CALO-Meeting-Assistant System," IEEE Transactions on Audio, Speech, and Language Processing, vol. 18, No. 6, Aug. 2010, 11 pages.
Tur, G., et al., "The CALO Meeting Speech Recognition and Understanding System," 2008, Proc. IEEE Spoken Language Technology Workshop, 4 pages.
Vlingo, "Vlingo Launches Voice Enablement Application on Apple App Store," Vlingo press release dated Dec. 3, 2008, 2 pages.
Vlingo InCar, "Distracted Driving Solution with Vlingo InCar," 2:38 minute video uploaded to YouTube by Vlingo Voice on Oct. 6, 2010, http://www.youtube.com/watch?v=Vqs8XfXxgz4, 2 pages.
YouTube, "Knowledge Navigator," 5:34 minute video uploaded to YouTube by Knownav on Apr. 29, 2008, http://www.youtube.com/watch?v=QRH8eimU_20, 1 page.
YouTube,"Send Text, Listen to and Send E-Mail 'By Voice' www.voiceassist.com," 2:11 minute video uploaded to YouTube by VoiceAssist on Jul 30, 2009, http://www.youtube.com/watch?v=0tEU61nHHA4, 1 page.
YouTube,"Text'nDrive App Demo—Listen and Reply to your Messages by Voice while Driving!," 1:57 minute video uploaded to YouTube by TextnDrive on Apr 27, 2010, http://www.youtube.com/watch?v=WaGfzoHsAMw, 1 page.
YouTube, "Voice on the Go (BlackBerry)," 2:51 minute video uploaded to YouTube by VoiceOnTheGo on Jul. 27, 2009, http://www.youtube.com/watch?v=pJqpWgQS98w, 1 page.
Zue, V., "Conversational Interfaces: Advances and Challenges," Sep. 1997, http://www.cs.cmu.edu/~dod/papers/zue97.pdf, 10 pages.
Zue, V. W., "Toward Systems that Understand Spoken Language," Feb. 1994, ARPA Strategic Computing Institute, © 1994 IEEE, 9 pages.

(56) References Cited

OTHER PUBLICATIONS

International Search Report and Written Opinion dated Nov. 29, 2011, received in International Application No. PCT/US2011/20861, which corresponds to U.S. Appl. No. 12/987,982, 15 pages. (Thomas Robert Gruber).
International Search Report and Written Opinion dated Oct. 4, 2011, received in International Application No. PCT/US2011/037014, which corresponds to U.S. Appl. No. 12/794,643, 16 pages. (Aram Lindahl).
Invitation to Pay Additional Search Fees dated Aug. 2, 2011 for PCT Application No. PCT/US2011/037014, which corresponds to U.S. Appl. No. 12/794,643, 6 pages. (Aram Lindahl).
EP Communication under Rule-161(1) and 162 EPC dated Jan. 17, 2013 for Application No. 11727351.6, 4 pages.
International Preliminary Report on Patentability received for PCT Application No. PCT/US2011/037014, dated Dec. 13, 2012, 10 pages.
Advisory Action received for U.S. Appl. No. 12/794,643, dated Sep. 9, 2013, 2 pages.
Decision Grant received for European Patent Application No. 11727351.6, dated Oct. 7, 2016, 2 pages.
Final Office Action received for U.S. Appl. No. 12/794,643, dated Jun. 3, 2013, 6 pages.
Intention to Grant received for European Patent Application No. 11727351.6, dated May 23, 2016, 8 pages.
Non-Final Office Action received for U.S. Appl. No. 12/794,643 , dated Dec. 6, 2012, 7 pages.
Notice of Allowance received for U.S. Appl. No. 12/794,643, dated Sep. 30, 2013, 6 pages.
Office Action received for Chinese Patent Application No. 2011800211261, dated Sep. 17, 2013, 11 pages (5 pages of English Translation and 6 Page of Official Copy).
Office Action received for European Patent Application No. 11727351.6, dated Jun. 11, 2015, 3 pages.
Office Action received for Japanese Patent Application No. 2013-513202, dated Jan. 7, 2014, 8 pages (5 pages of English Translation and 3 pages of Official Copy).
Office Action received for Japanese Patent Application No. 2013-513202, dated Mar. 2, 2015, 9 pages (6 pages of English Translation and 3 pages of Official Copy).
Office Action received for Japanese Patent Application No. 2013-513202, dated Sep. 28, 2015, 2 pages (Official Copy Only) {See Communication under 37 CFR § 1.98(a) (3)}.
Office Action received for Korean Patent Application No. 10-2012-7030410, dated Jun. 20, 2014, 4 pages (Official Copy Only) {See Communication under 37 CFR § 1.98(a) (3)}.

* cited by examiner

USER-SPECIFIC NOISE SUPPRESSION FOR VOICE QUALITY IMPROVEMENTS

RELATED APPLICATIONS

This application is a continuation of U.S. application Ser. No. 12/794,643, filed Jun. 4, 2010, which application is incorporated by reference herein in its entirety.

BACKGROUND

The present disclosure relates generally to techniques for noise suppression and, more particularly, for user-specific noise suppression.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Many electronic devices employ voice-related features that involve recording and/or transmitting a user's voice. Voice note recording features, for example, may record voice notes spoken by the user. Similarly, a telephone feature of an electronic device may transmit the user's voice to another electronic device. When an electronic device obtains a user's voice, however, ambient sounds or background noise may be obtained at the same time. These ambient sounds may obscure the user's voice and, in some cases, may impede the proper functioning of a voice-related feature of the electronic device.

To reduce the effect of ambient sounds when a voice-related feature is in use, electronic devices may apply a variety of noise suppression schemes. Device manufactures may program such noise suppression schemes to operate according to certain predetermined generic parameters calculated to be well-received by most users. However, certain voices may be less well suited for these generic noise suppression parameters. Additionally, some users may prefer stronger or weaker noise suppression.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to systems, methods, and devices for user-specific noise suppression. For example, when a voice-related feature of an electronic device is in use, the electronic device may receive an audio signal that includes a user voice. Since noise, such as ambient sounds, also may be received by the electronic device at this time, the electronic device may suppress such noise in the audio signal. In particular, the electronic device may suppress the noise in the audio signal while substantially preserving the user voice via user-specific noise suppression parameters. These user-specific noise suppression parameters may be based at least in part on a user noise suppression preference or a user voice profile, or a combination thereof.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
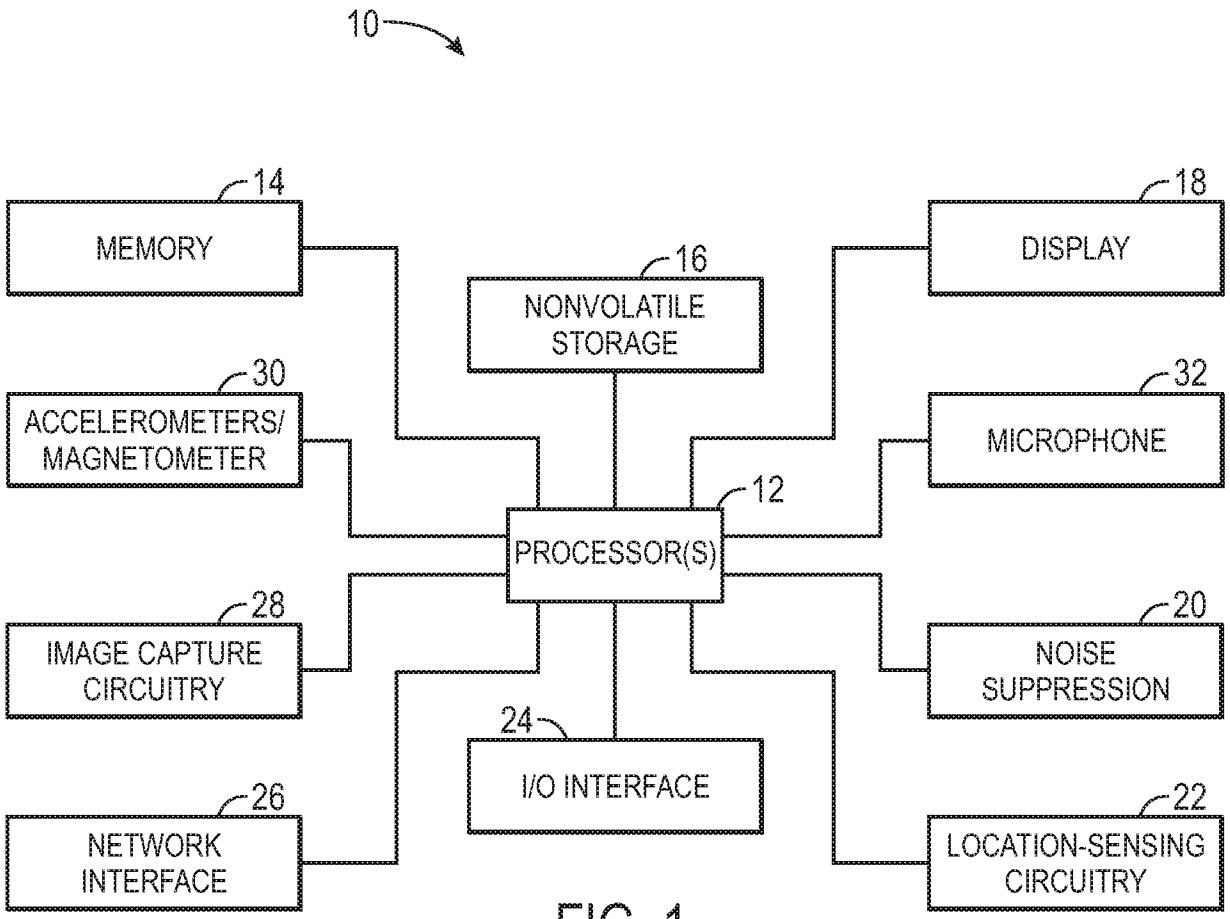
FIG. 1 is a block diagram of an electronic device capable of performing the techniques disclosed herein, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments relate to suppressing noise in an audio signal associated with a voice-related feature of an electronic device. Such a voice-related feature may include, for example, a voice note recording feature, a video recording feature, a telephone feature, and/or a voice command feature, each of which may involve an audio signal that includes a user's voice. In addition to the user's voice, however, the audio signal also may include ambient sounds present while the voice-related feature is in use. Since these ambient sounds may obscure the user's voice, the electronic device may apply noise suppression to the audio signal to filter out the ambient sounds while preserving the user's voice.

Rather than employ generic noise suppression parameters programmed at the manufacture of the device, noise suppression according to present embodiments may involve user-specific noise suppression parameters that may be unique to a user of the electronic device. These user-specific noise suppression parameters may be determined through voice training, based on a voice profile of the user, and/or based on a manually selected user setting. When noise suppression takes place based on user-specific parameters rather than generic parameters, the sound of the noise-suppressed signal may be more satisfying to the user. These user-specific noise suppression parameters may be employed in any voice-related feature, and may be used in connection with automatic gain control (AGC) and/or equalization (EQ) tuning.

As noted above, the user-specific noise suppression parameters may be determined using a voice training sequence. In such a voice training sequence, the electronic device may apply varying noise suppression parameters to a user's voice sample mixed with one or more distractors (e.g., simulated ambient sounds such as crumpled paper, white noise, babbling people, and so forth). The user may thereafter indicate which noise suppression parameters produce the most preferable sound. Based on the user's feedback, the electronic device may develop and store the user-specific noise suppression parameters for later use when a voice-related feature of the electronic device is in use.

Additionally or alternatively, the user-specific noise suppression parameters may be determined by the electronic device automatically depending on characteristics of the user's voice. Different users' voices may have a variety of different characteristics, including different average frequencies, different variability of frequencies, and/or different distinct sounds. Moreover, certain noise suppression parameters may be known to operate more effectively with certain voice characteristics. Thus, an electronic device according to certain present embodiments may determine the user-specific noise suppression parameters based on such user voice characteristics. In some embodiments, a user may manually set the noise suppression parameters by, for example, selecting a high/medium/low noise suppression strength selector or indicating a current call quality on the electronic device.

When the user-specific parameters have been determined, the electronic device may suppress various types of ambient sounds that may be heard while a voice-related feature is being used. In certain embodiments, the electronic device may analyze the character of the ambient sounds and apply a user-specific noise suppression parameter that is expected to thus suppress the current ambient sounds. In another embodiment, the electronic device may apply certain user-specific noise suppression parameters based on the current context in which the electronic device is being used.

In certain embodiments, the electronic device may perform noise suppression tailored to the user based on a user voice profile associated with the user. Thereafter, the electronic device may more effectively isolate ambient sounds from an audio signal when a voice-related feature is being used because the electronic device generally may expect which components of an audio signal correspond to the user's voice. For example, the electronic device may amplify components of an audio signal associated with a user voice profile while suppressing components of the audio signal not associated with the user voice profile.

User-specific noise suppression parameters also may be employed to suppress noise in audio signals containing voices other than that of the user that are received by the electronic device. For example, when the electronic device is used for a telephone or chat feature, the electronic device may employ the user-specific noise suppression parameters to an audio signal from a person with whom the user is corresponding. Since such an audio signal may have been previously processed by the sending device, such noise suppression may be relatively minor. In certain embodiments, the electronic device may transmit the user-specific noise suppression parameters to the sending device, so that the sending device may modify its noise suppression parameters accordingly. In the same way, two electronic devices may function systematically to suppress noise in outgoing audio signals according to each other's user-specific noise suppression parameters.

Figure 2:
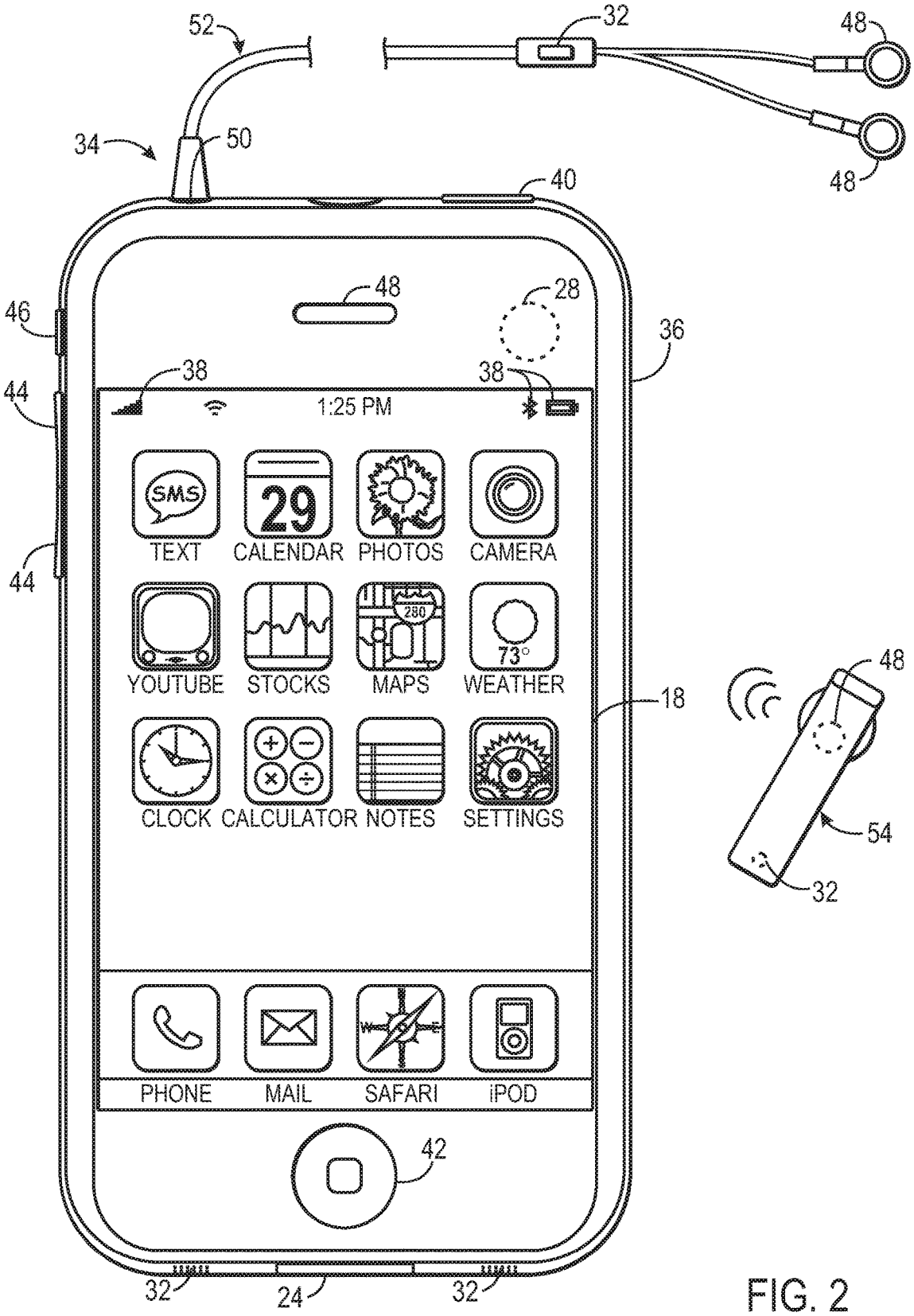
FIG. 2 is a schematic view of a handheld device representing one embodiment of the electronic device of FIG. 1.

With the foregoing in mind, a general description of suitable electronic devices for performing the presently disclosed techniques is provided below. In particular, FIG. 1 is a block diagram depicting various components that may be present in an electronic device suitable for use with the present techniques. FIG. 2 represents one example of a suitable electronic device, which may be, as illustrated, a handheld electronic device having noise suppression capabilities.

Turning first to FIG. 1, an electronic device 10 for performing the presently disclosed techniques may include, among other things, one or more processor(s) 12, memory 14, nonvolatile storage 16, a display 18, noise suppression 20, location-sensing circuitry 22, an input/output (I/O) interface 24, network interfaces 26, image capture circuitry 28, accelerometers/magnetometer 30, and a microphone 32. The various functional blocks shown in FIG. 1 may include hardware elements (including circuitry), software elements (including computer code stored on a computer-readable medium) or a combination of both hardware and software elements. It should further be noted that FIG. 1 is merely one example of a particular implementation and is intended to illustrate the types of components that may be present in electronic device 10.

By way of example, the electronic device 10 may represent a block diagram of the handheld device depicted in FIG. 2 or similar devices. Additionally or alternatively, the electronic device 10 may represent a system of electronic devices with certain characteristics. For example, a first electronic device may include at least a microphone 32, which may provide audio to a second electronic device including the processor(s) 12 and other data processing circuitry. It should be noted that the data processing circuitry may be embodied wholly or in part as software, firmware, hardware or any combination thereof. Furthermore the data processing circuitry may be a single contained processing module or may be incorporated wholly or partially within any of the other elements within electronic device 10. The data processing circuitry may also be partially embodied within electronic device 10 and partially embodied within another electronic device wired or wirelessly connected to device 10. Finally, the data processing circuitry may be wholly implemented within another device wired or wirelessly connected to device 10. As a non-limiting example, data processing circuitry might be embodied within a headset in connection with device 10.

In the electronic device 10 of FIG. 1, the processor(s) 12 and/or other data processing circuitry may be operably coupled with the memory 14 and the nonvolatile memory 16 to perform various algorithms for carrying out the presently disclosed techniques. Such programs or instructions executed by the processor(s) 12 may be stored in any suitable manufacture that includes one or more tangible, computer-readable media at least collectively storing the instructions or routines, such as the memory 14 and the nonvolatile storage 16. Also, programs (e.g., an operating system) encoded on such a computer program product may also include instructions that may be executed by the processor(s) 12 to enable the electronic device 10 to provide various functionalities, including those described herein. The display 18 may be a touch-screen display, which may enable users to interact with a user interface of the electronic device 10.

The noise suppression 20 may be performed by data processing circuitry such as the processor(s) 12 or by circuitry dedicated to performing certain noise suppression on audio signals processed by the electronic device 10. For example, the noise suppression 20 may be performed by a baseband integrated circuit (IC), such as those manufactured by Infineon, based on externally provided noise suppression parameters. Additionally or alternatively, the noise suppression 20 may be performed in a telephone audio enhancement integrated circuit (IC) configured to perform noise suppression based on externally provided noise suppression parameters, such as those manufactured by Audience. These noise suppression ICs may operate at least partly based on certain noise suppression parameters. Varying such noise suppression parameters may vary the output of the noise suppression 20.

The location-sensing circuitry 22 may represent device capabilities for determining the relative or absolute location of electronic device 10. By way of example, the location-sensing circuitry 22 may represent Global Positioning System (GPS) circuitry, algorithms for estimating location based on proximate wireless networks, such as local Wi-Fi networks, and so forth. The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G cellular network. Through the network interfaces 26, the electronic device 10 may interface with a wireless headset that includes a microphone 32. The image capture circuitry 28 may enable image and/or video capture, and the accelerometers/magnetometer 30 may observe the movement and/or a relative orientation of the electronic device 10.

When employed in connection with a voice-related feature of the electronic device 10, such as a telephone feature or a voice recognition feature, the microphone 32 may obtain an audio signal of a user's voice. Though ambient sounds may also be obtained in the audio signal in addition to the user's voice, the noise suppression 20 may process the audio signal to exclude most ambient sounds based on certain user-specific noise suppression parameters. As described in greater detail below, the user-specific noise suppression parameters may be determined through voice training, based on a voice profile of the user, and/or based on a manually selected user setting.

FIG. 2 depicts a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices. As indicated in FIG. 2, the reverse side of the handheld device 34 may include the image capture circuitry 28.

User input structures 40, 42, 44, and 46, in combination with the display 18, may allow a user to control the handheld device 34. For example, the input structure 40 may activate or deactivate the handheld device 34, the input structure 42 may navigate user interface 20 to a home screen, a user-configurable application screen, and/or activate a voice-recognition feature of the handheld device 34, the input structures 44 may provide volume control, and the input structure 46 may toggle between vibrate and ring modes. The microphone 32 may obtain a user's voice for various voice-related features, and a speaker 48 may enable audio playback and/or certain phone capabilities. Headphone input 50 may provide a connection to external speakers and/or headphones.

As illustrated in FIG. 2, a wired headset 52 may connect to the handheld device 34 via the headphone input 50. The wired headset 52 may include two speakers 48 and a microphone 32. The microphone 32 may enable a user to speak into the handheld device 34 in the same manner as the microphones 32 located on the handheld device 34. In some embodiments, a button near the microphone 32 may cause the microphone 32 to awaken and/or may cause a voice-related feature of the handheld device 34 to activate. A wireless headset 54 may similarly connect to the handheld device 34 via a wireless interface (e.g., a Bluetooth interface) of the network interfaces 26. Like the wired headset 52, the wireless headset 54 may also include a speaker 48 and a microphone 32. Also, in some embodiments, a button near the microphone 32 may cause the microphone 32 to awaken and/or may cause a voice-related feature of the handheld device 34 to activate. Additionally or alternatively, a standalone microphone 32 (not shown), which may lack an integrated speaker 48, may interface with the handheld device 34 via the headphone input 50 or via one of the network interfaces 26.

Figure 3:
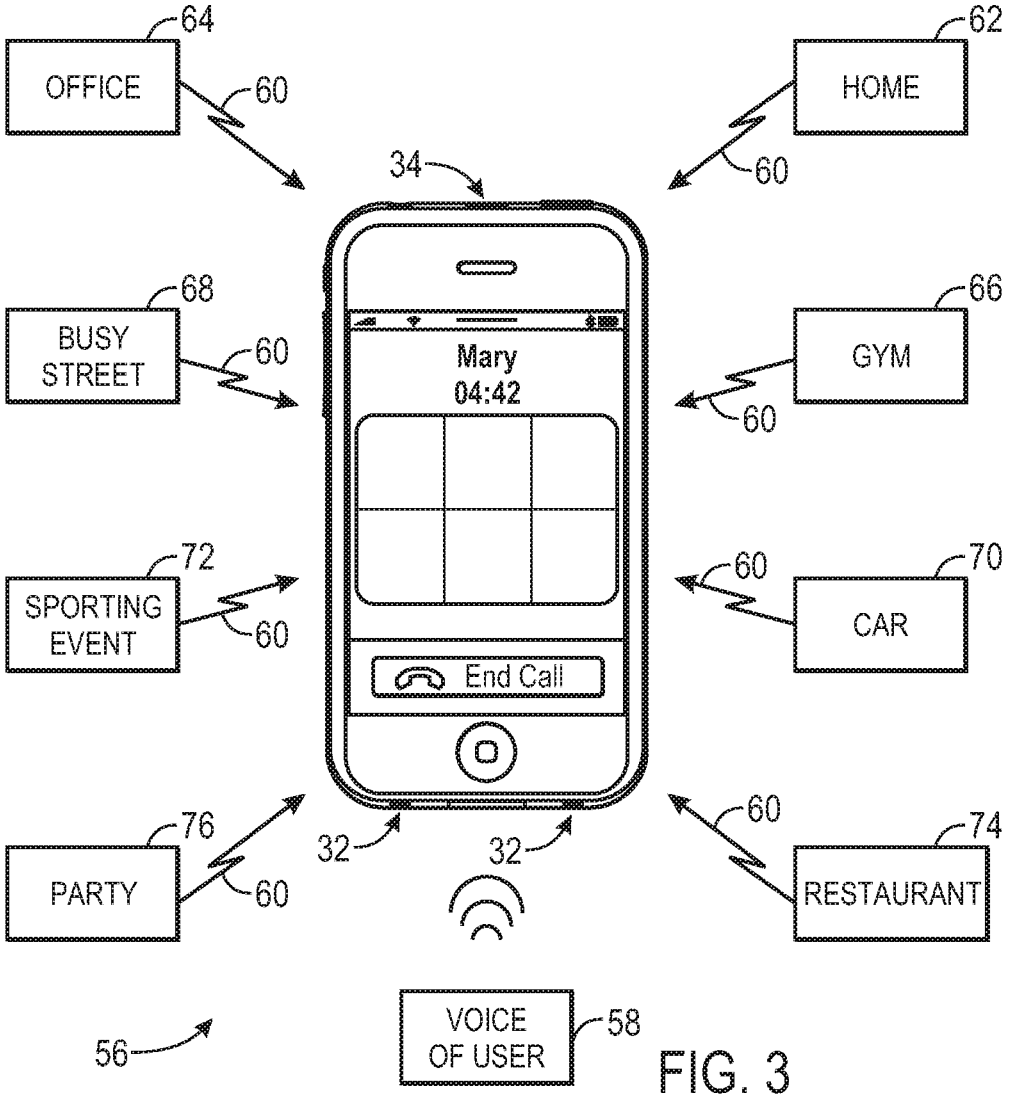
FIG. 3 is a schematic block diagram representing various context in which a voice-related feature of the electronic device of FIG. 1 may be used, in accordance with an embodiment.

A user may use a voice-related feature of the electronic device 10, such as a voice-recognition feature or a telephone feature, in a variety of contexts with various ambient sounds. FIG. 3 illustrates many such contexts 56 in which the electronic device 10, depicted as the handheld device 34, may obtain a user voice audio signal 58 and ambient sounds 60 while performing a voice-related feature. By way of example, the voice-related feature of the electronic device 10 may include, for example, a voice recognition feature, a voice note recording feature, a video recording feature, and/or a telephone feature. The voice-related feature may be implemented on the electronic device 10 in software carried out by the processor(s) 12 or other processors, and/or may be implemented in specialized hardware.

When the user speaks the voice audio signal 58, it may enter the microphone 32 of the electronic device 10. At approximately the same time, however, ambient sounds 60 also may enter the microphone 32. The ambient sounds 60 may vary depending on the context 56 in which the electronic device 10 is being used. The various contexts 56 in which the voice-related feature may be used may include at home 62, in the office 64, at the gym 66, on a busy street 68, in a car 70, at a sporting event 72, at a restaurant 74, and at a party 76, among others. As should be appreciated, the typical ambient sounds 60 that occur on a busy street 68 may differ greatly from the typical ambient sounds 60 that occur at home 62 or in a car 70.

The character of the ambient sounds 60 may vary from context 56 to context 56. As described in greater detail below, the electronic device 10 may perform noise suppression 20 to filter the ambient sounds 60 based at least partly on user-specific noise suppression parameters. In some embodiments, these user-specific noise suppression parameters may be determined via voice training, in which a variety of different noise suppression parameters may be tested on an audio signal including a user voice sample and various distractors (simulated ambient sounds). The distractors employed in voice training may be chosen to mimic the ambient sounds 60 found in certain contexts 56. Additionally, each of the contexts 56 may occur at certain locations and times, with varying amounts of electronic device 10 motion and ambient light, and/or with various volume levels of the voice signal 58 and the ambient sounds 60. Thus, the electronic device 10 may filter the ambient sounds 60 using user-specific noise suppression parameters tailored to certain contexts 56, as determined based on time, location, motion, ambient light, and/or volume level, for example.

Figure 4:
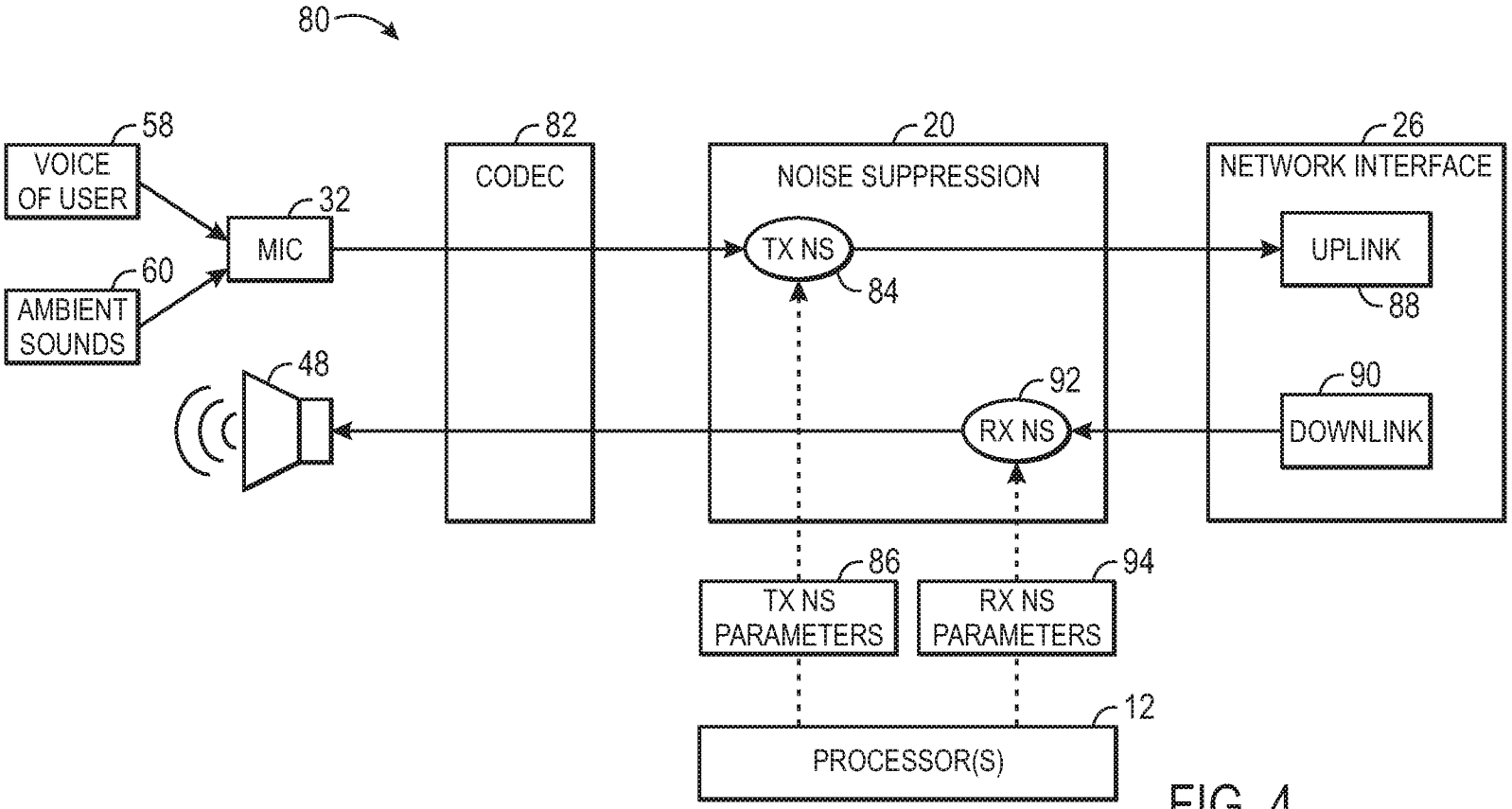
FIG. 4 is a block diagram of noise suppression that may take place in the electronic device of FIG. 1, in accordance with an embodiment.

FIG. 4 is a schematic block diagram of a technique 80 for performing the noise suppression 20 on the electronic device 10 when a voice-related feature of the electronic device 10 is in use. In the technique 80 of FIG. 4, the voice-related feature involves two-way communication between a user and another person and may take place when a telephone or chat feature of the electronic device 10 is in use. However, it should be appreciated that the electronic device 10 also may perform the noise suppression 20 on an audio signal either received through the microphone 32 or the network interface 26 of the electronic device when two-way communication is not occurring.

In the noise suppression technique 80, the microphone 32 of the electronic device 10 may obtain a user voice signal 58 and ambient sounds 60 present in the background. This first audio signal may be encoded by a codec 82 before entering noise suppression 20. In the noise suppression 20, transmit noise suppression (TX NS) 84 may be applied to the first audio signal. The manner in which noise suppression 20 occurs may be defined by certain noise suppression parameters (illustrated as transmit noise suppression (TX NS) parameters 86) provided by the processor(s) 12, memory 14, or nonvolatile storage 16, for example. As discussed in greater detail below, the TX NS parameters 86 may be user-specific noise suppression parameters determined by the processor(s) 12 and tailored to the user and/or context 56 of the electronic device 10. After performing the noise suppression 20 at numeral 84, the resulting signal may be passed to an uplink 88 through the network interface 26.

A downlink 90 of the network interface 26 may receive a voice signal from another device (e.g., another telephone). Certain noise receiver noise suppression (RX NS) 92 may be applied to this incoming signal in the noise suppression 20. The manner in which such noise suppression 20 occurs may be defined by certain noise suppression parameters (illustrated as receive noise suppression (RX NS) parameters 94) provided by the processor(s) 12, memory 14, or nonvolatile storage 16, for example. Since the incoming audio signal previously may have been processed for noise suppression before leaving the sending device, the RX NS parameters 94 may be selected to be less strong than the TX NS parameters 86. The resulting noise-suppressed signal may be decoded by the codec 82 and output to receiver circuitry and/or a speaker 48 of the electronic device 10.

Figure 5:
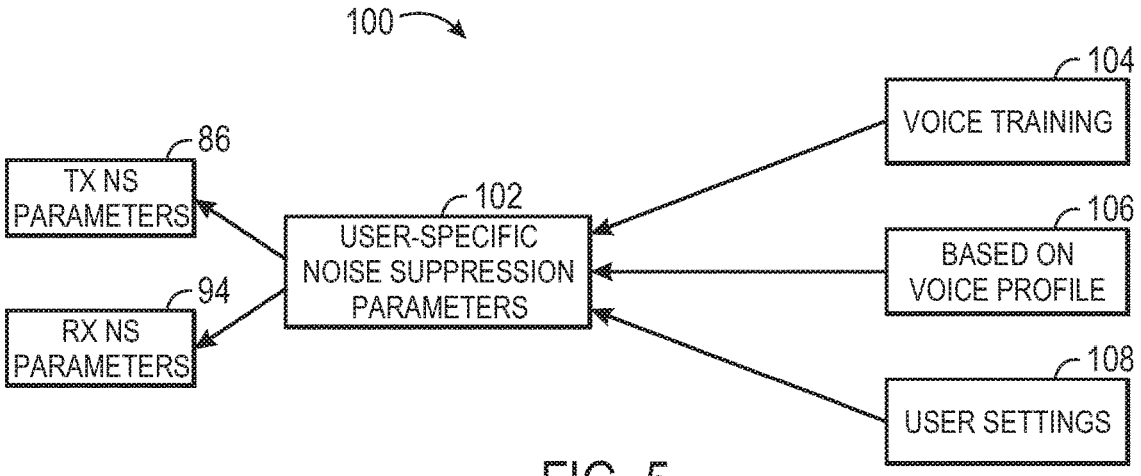
FIG. 5 is a block diagram representing user-specific noise suppression parameters, in accordance with an embodiment.

The TX NS parameters 86 and/or the RX NS parameters 94 may be specific to the user of the electronic device 10. That is, as shown by a diagram 100 of FIG. 5, the TX NS parameters 86 and the RX NS parameters 94 may be selected from user-specific noise suppression parameters 102 that are tailored to the user of the electronic device 10. These user-specific noise suppression parameters 102 may be obtained in a variety of ways, such as through voice training 104, based on a user voice profile 106, and/or based on user-selectable settings 108, as described in greater detail below.

Figure 17:
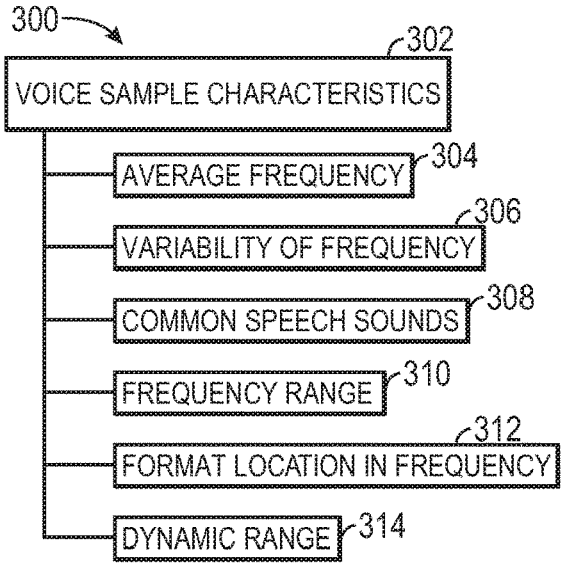
FIG. 17 is a factor diagram describing characteristics of a user voice sample that may be considered while performing the method of FIG. 16, in accordance with an embodiment.
Figure 18:
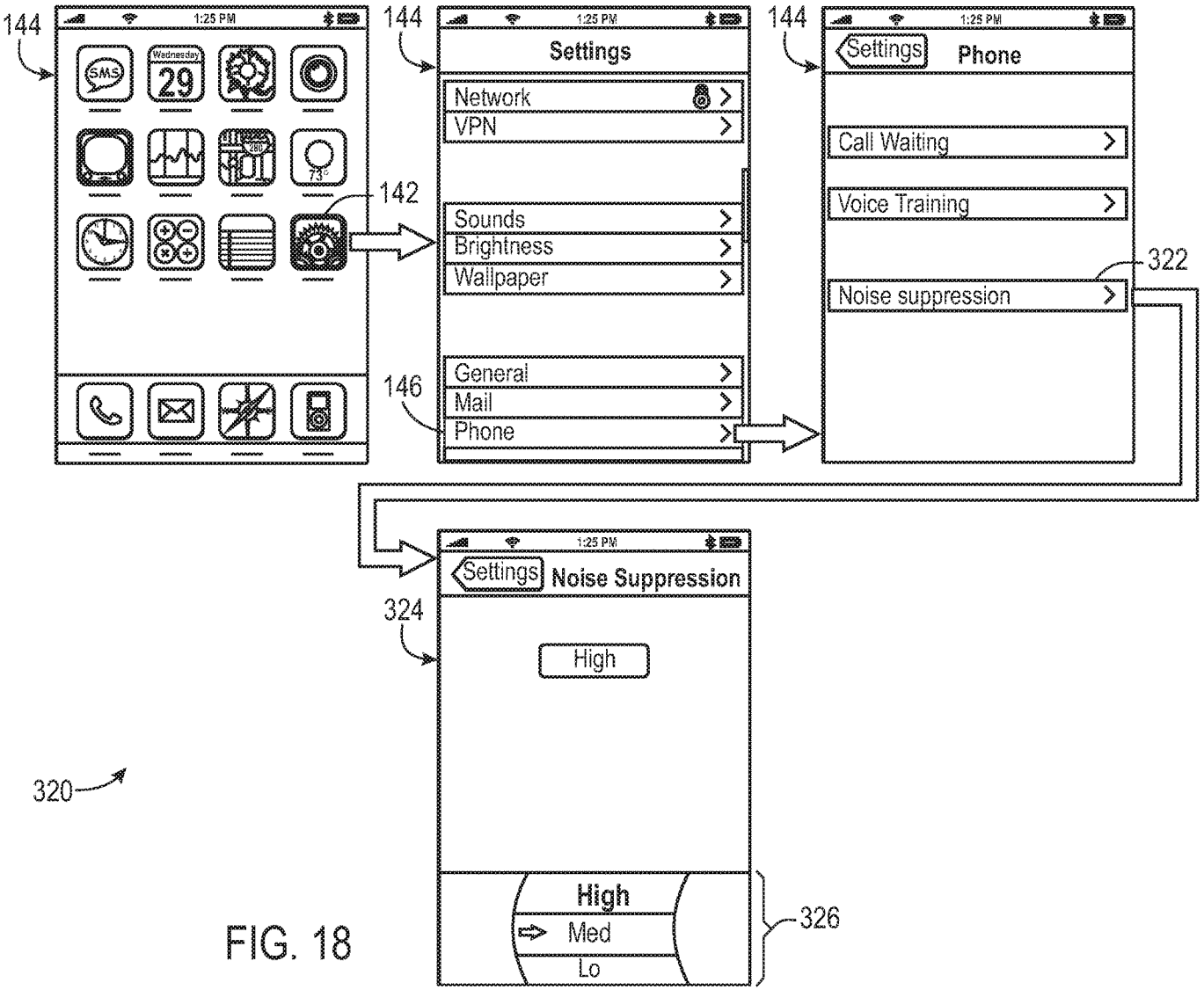
FIG. 18 is a schematic diagram representing a series of screens that may be displayed on the handheld device of FIG. 2 to obtain a user-specific noise parameters via a user-selectable setting, in accordance with an embodiment.
Figure 19:
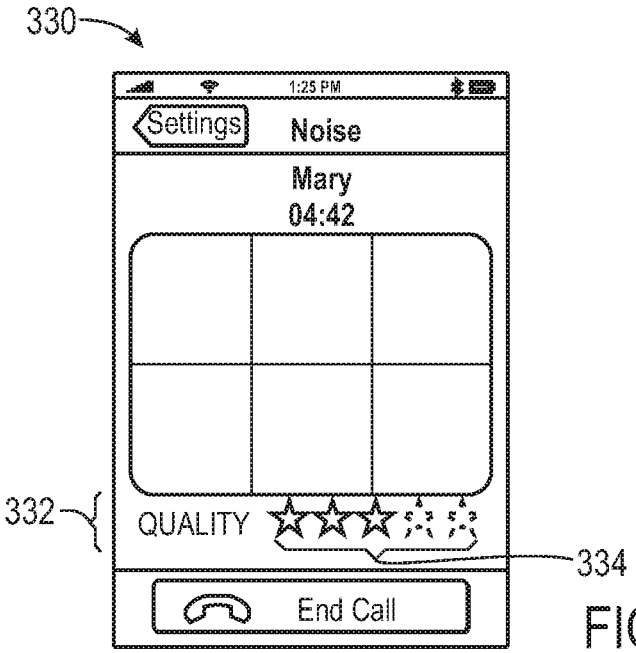
FIG. 19 is a schematic diagram of a screen on the handheld device of FIG. 2 for obtaining user-specified noise suppression parameters in real-time while a voice-related feature of the handheld device is in use, in accordance with an embodiment.

Voice training 104 may allow the electronic device 10 to determine the user-specific noise suppression parameters 102 by way of testing a variety of noise suppression parameters combined with various distractors or simulated background noise. Certain embodiments for performing such voice training 104 are discussed in greater detail below with reference to FIGS. 7-14. Additionally or alternatively, the electronic device 10 may determine the user-specific noise suppression parameters 102 based on a user voice profile 106 that may consider specific characteristics of the user's voice, as discussed in greater detail below with reference to FIGS. 15-17. Additionally or alternatively, a user may indicate preferences for the user-specific noise suppression parameters 102 through certain user settings 108, as discussed in greater detail below with reference to FIGS. 18 and 19. Such user-selectable settings may include, for example, a noise suppression strength (e.g., low/medium/high) selector and/or a real-time user feedback selector to provide user feedback regarding the user's real-time voice quality.

In general, the electronic device 10 may employ the user-specific noise suppression parameters 102 when a voice-related feature of the electronic device is in use (e.g., the TX NS parameters 86 and the RX NS parameters 94 may be selected based on the user-specific noise suppression parameters 102). In certain embodiments, the electronic device 10 may apply certain user-specific noise suppression parameters 102 during noise suppression 20 based on an identification of the user who is currently using the voice-related feature. Such a situation may occur, for example, when an electronic device 10 is used by other family members. Each member of the family may represent a user that may sometimes use a voice-related feature of the electronic device 10. Under such multi-user conditions, the electronic device 10 may ascertain whether there are user-specific noise suppression parameters 102 associated with that user.

Figure 6:
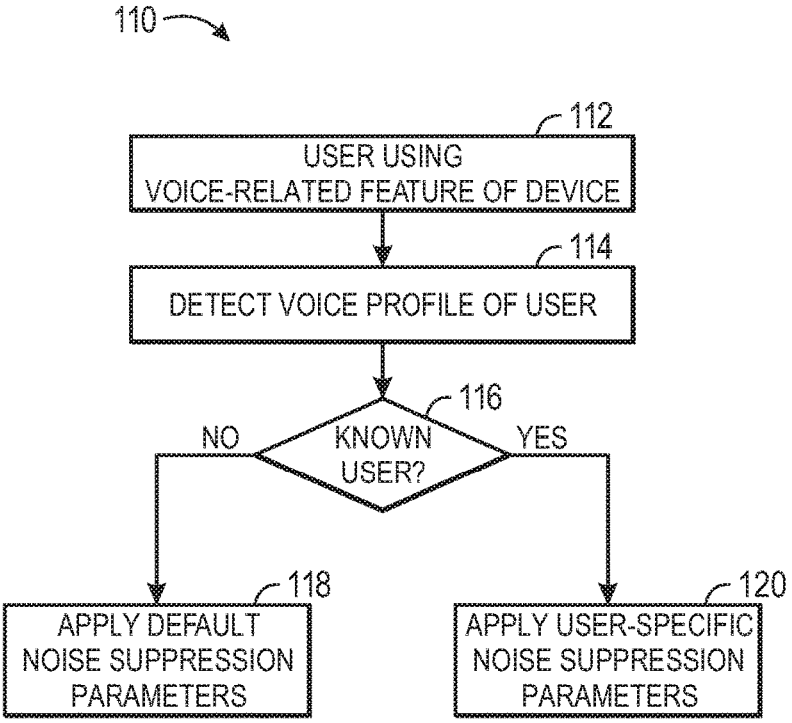
FIG. 6 is a flow chart describing an embodiment of a method for applying user-specific noise suppression parameters in the electronic device of FIG. 1.

For example, FIG. 6 illustrates a flowchart 110 for applying certain user-specific noise suppression parameters 102 when a user has been identified. The flowchart 110 may begin when a user is using a voice-related feature of the electronic device 10 (block 112). In carrying out the voice-related feature, the electronic device 10 may receive an audio signal that includes a user voice signal 58 and ambient sounds 60. From the audio signal, the electronic device 10 generally may determine certain characteristics of the user's voice and/or may identify a user voice profile from the user voice signal 58 (block 114). As discussed below, a user voice profile may represent information that identifies certain characteristics associated with the voice of a user.

If the voice profile detected at block 114 does not match any known users with whom user-specific noise suppression parameters 102 are associated (block 116), the electronic device 10 may apply certain default noise suppression parameters for noise suppression 20 (block 118). However, if the voice profile detected in block 114 does match a known user of the electronic device 10, and the electronic device 10 currently stores user-specific noise suppression parameters 102 associated with that user, the electronic device 10 may instead apply the associated user-specific noise suppression parameters 102 (block 120).

Figure 7:
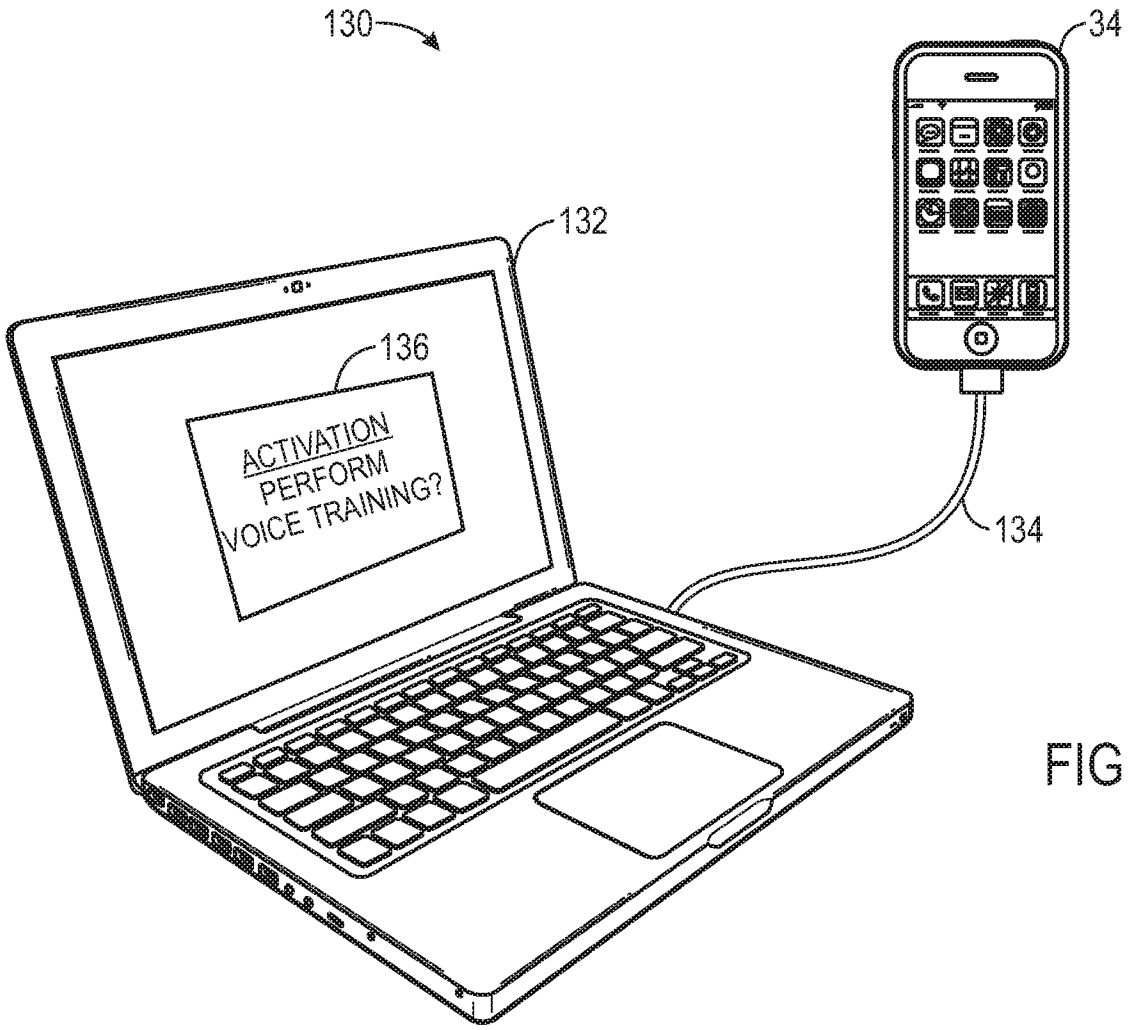
FIG. 7 is a schematic diagram of the initiation of a voice training sequence when the handheld device of FIG. 2 is activated, in accordance with an embodiment.

As mentioned above, the user-specific noise suppression parameters 102 may be determined based on a voice training sequence 104. The initiation of such a voice training sequence 104 may be presented as an option to a user during an activation phase 130 of an embodiment of the electronic device 10, such as the handheld device 34, as shown in FIG. 7. In general, such an activation phase 130 may take place when the handheld device 34 first joins a cellular network or first connects to a computer or other electronic device 132 via a communication cable 134. During such an activation phase 130, the handheld device 34 or the computer or other device 132 may provide a prompt 136 to initiate voice training. Upon selection of the prompt, a user may initiate the voice training 104.

Figure 8:
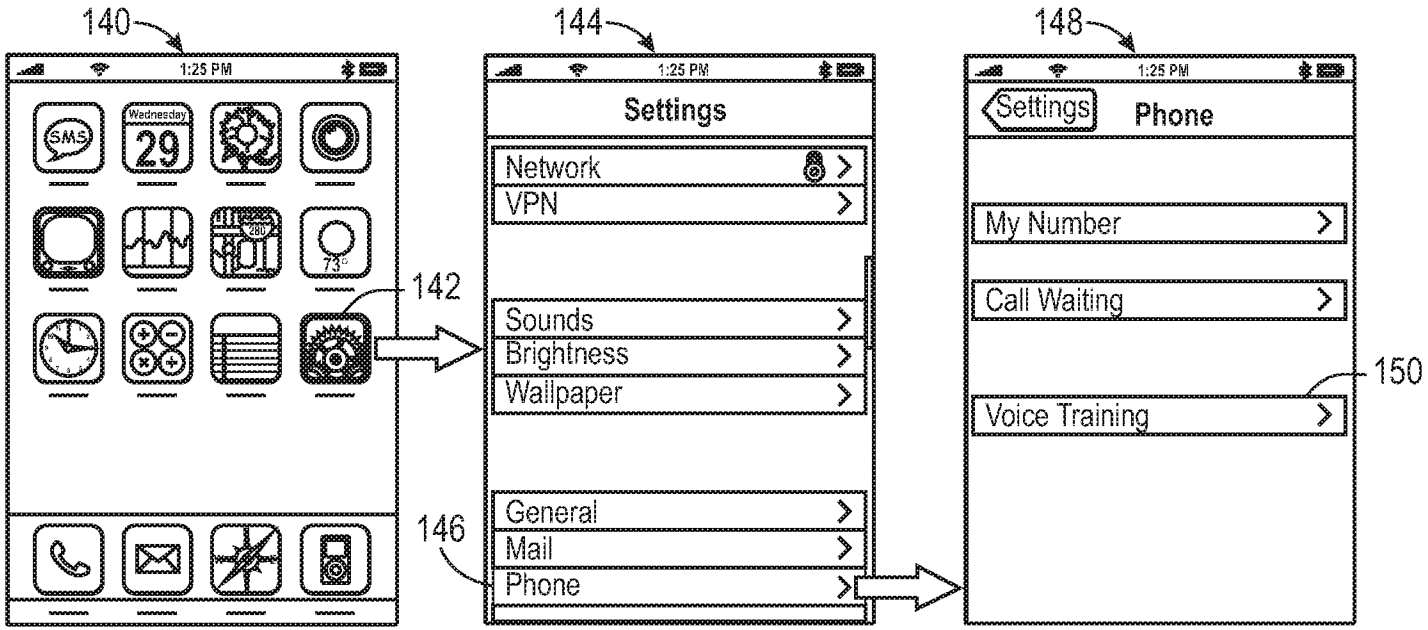
FIG. 8 is a schematic diagram of a series of screens for selecting the initiation of a voice training sequence using the handheld device of FIG. 2, in accordance with an embodiment.

Additionally or alternatively, a voice training sequence 104 may begin when a user selects a setting of the electronic device 10 that causes the electronic device 10 to enter a voice training mode. As shown in FIG. 8, a home screen 140 of the handheld device 34 may include a user-selectable button 142 that, when selected causes the handheld device 34 to display a settings screen 144. When a user selects a user-selectable button 146 labeled "phone" on the settings screen 144, the handheld device 34 may display a phone settings screen 148. The phone settings screen 148 may include, among other things, a user-selectable button 150 labeled "voice training" When a user selects the voice training button 150, a voice training 104 sequence may begin.

Figure 9:
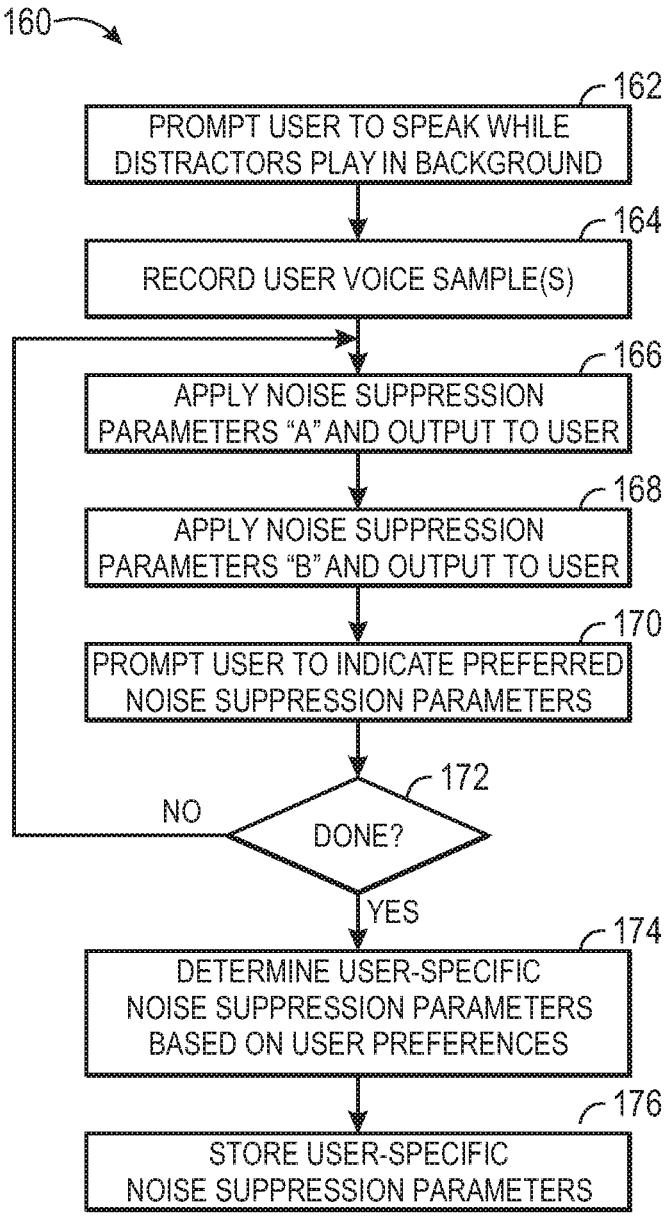
FIG. 9 is a flowchart describing an embodiment of a method for determining user-specific noise suppression parameters via a voice training sequence.

A flowchart 160 of FIG. 9 represents one embodiment of a method for performing the voice training 104. The flowchart 160 may begin when the electronic device 10 prompts the user to speak while certain distractors (e.g., simulated ambient sounds) play in the background (block 162). For example, the user may be asked to speak a certain word or phrase while certain distractors, such as rock music, babbling people, crumpled paper, and so forth, are playing aloud on the computer or other electronic device 132 or on a speaker 48 of the electronic device 10. While such distractors are playing, the electronic device 10 may record a sample of the user's voice (block 164). In some embodiments, blocks 162 and 164 may repeat while a variety of distractors are played to obtain several test audio signals that include both the user's voice and one or more distractors.

To determine which noise suppression parameters a user most prefers, the electronic device 10 may alternatingly apply certain test noise suppression parameters while noise suppression 20 is applied to the test audio signals before requesting feedback from the user. For example, the electronic device 10 may apply a first set of test noise suppression parameters, here labeled "A," to the test audio signal including the user's voice sample and the one or more distractors, before outputting the audio to the user via a speaker 48 (block 166). Next, the electronic device 10 may apply another set of test noise suppression parameters, here labeled "B," to the user's voice sample before outputting the audio to the user via the speaker 48 (block 168). The user then may decide which of the two audio signals output by the electronic device 10 the user prefers (e.g., by selecting either "A" or "B" on a display 18 of the electronic device 10) (block 170).

The electronic device 10 may repeat the actions of blocks 166-170 with various test noise suppression parameters and with various distractors, learning more about the user's noise suppression preferences each time until a suitable set of user noise suppression preference data has been obtained (decision block 172). Thus, the electronic device 10 may test the desirability of a variety of noise suppression parameters as actually applied to an audio signal containing the user's voice as well as certain common ambient sounds. In some embodiments, with each iteration of blocks 166-170, the electronic device 10 may "tune" the test noise suppression parameters by gradually varying certain noise suppression parameters (e.g., gradually increasing or decreasing a noise suppression strength) until a user's noise suppression preferences have settled. In other embodiments, the electronic device 10 may test different types of noise suppression parameters in each iteration of blocks 166-170 (e.g., noise suppression strength in one iteration, noise suppression of certain frequencies in another iteration, and so forth). In any case, the blocks 166-170 may repeat until a desired number of user preferences have been obtained (decision block 172).

Based on the indicated user preferences obtained at block (s) 170, the electronic device 10 may develop user-specific noise suppression parameters 102 (block 174). By way of example, the electronic device 10 may arrive at a preferred set of user-specific noise suppression parameters 102 when the iterations of blocks 166-170 have settled, based on the user feedback of block(s) 170. In another example, if the iterations of blocks 166-170 each test a particular set of noise suppression parameters, the electronic device 10 may develop a comprehensive set of user-specific noise suppression parameters based on the indicated preferences to the particular parameters. The user-specific noise suppression parameters 102 may be stored in the memory 14 or the nonvolatile storage 16 of the electronic device 10 (block 176) for noise suppression when the same user later uses a voice-related feature of the electronic device 10.

Figure 10:
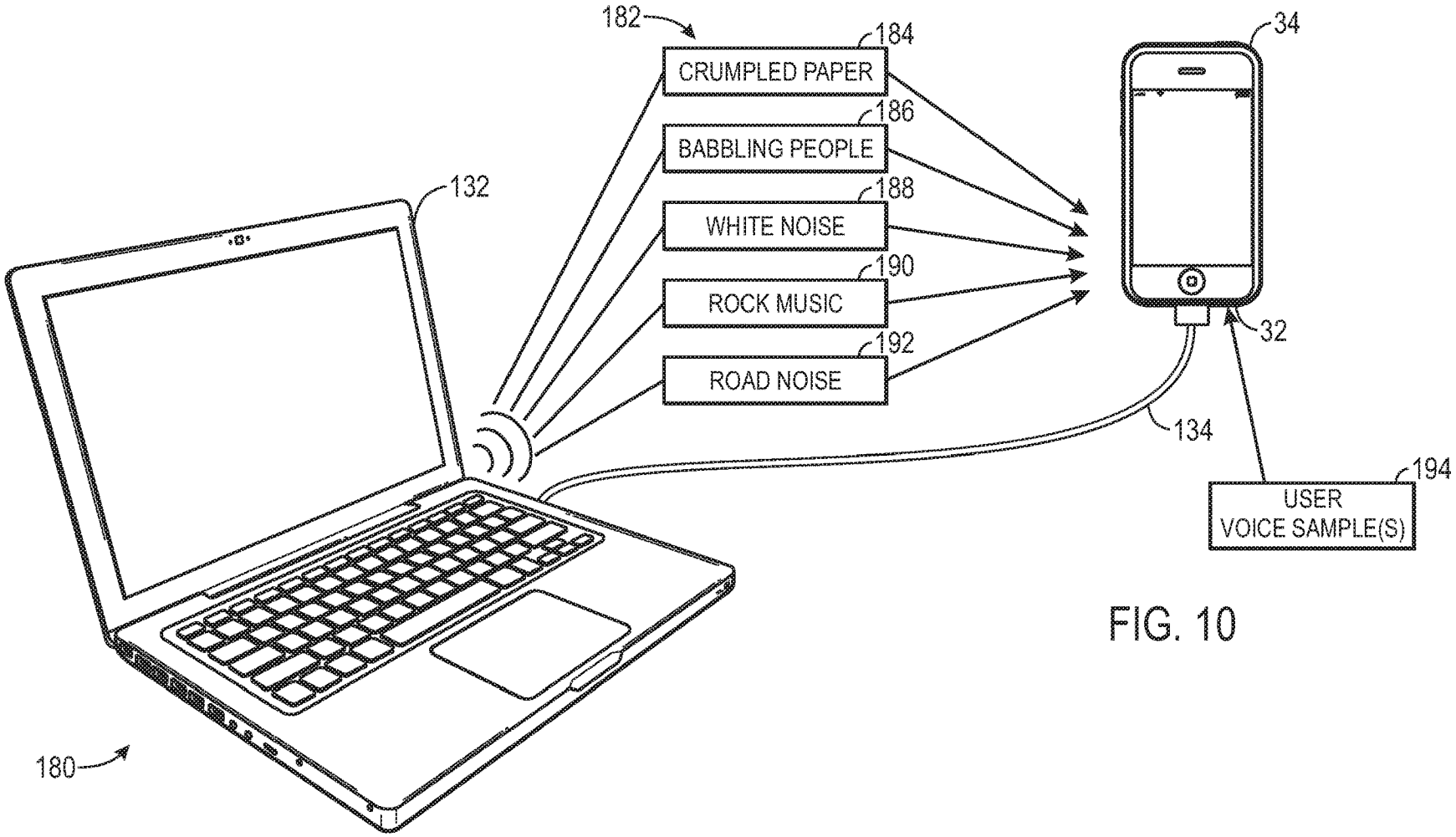
FIGS. 10 and 11 are schematic diagrams for a manner of obtaining a user voice sample for voice training, in accordance with an embodiment.

FIGS. 10-13 relate to specific manners in which the electronic device 10 may carry out the flowchart 160 of FIG. 9. In particular, FIGS. 10 and 11 relate to blocks 162 and 164 of the flowchart 160 of FIG. 9, and FIGS. 12 and 13A-B relate to blocks 166-172. Turning to FIG. 10, a dual-device voice recording system 180 includes the computer or other electronic device 132 and the handheld device 34. In some embodiments, the handheld device 34 may be joined to the computer or other electronic device 132 by way of a communication cable 134 or via wireless communication (e.g., an 802.11x Wi-Fi WLAN or a Bluetooth PAN). During the operation of the system 180, the computer or other electronic device 132 may prompt the user to say a word or phrase while one or more of a variety of distractors 182 play in the background. Such distractors 182 may include, for example, sounds of crumpled paper 184, babbling people 186, white noise 188, rock music 190, and/or road noise 192. The distractors 182 may additionally or alternatively include, for example, other noises commonly encountered in various contexts 56, such as those discussed above with reference to FIG. 3. These distractors 182, playing aloud from the computer or other electronic device 132, may be picked up by the microphone 32 of the handheld device 34 at the same time the user provides a user voice sample 194. In this manner, the handheld device 34 may obtain test audio signals that include both a distractor 182 and a user voice sample 194.

Figure 11:
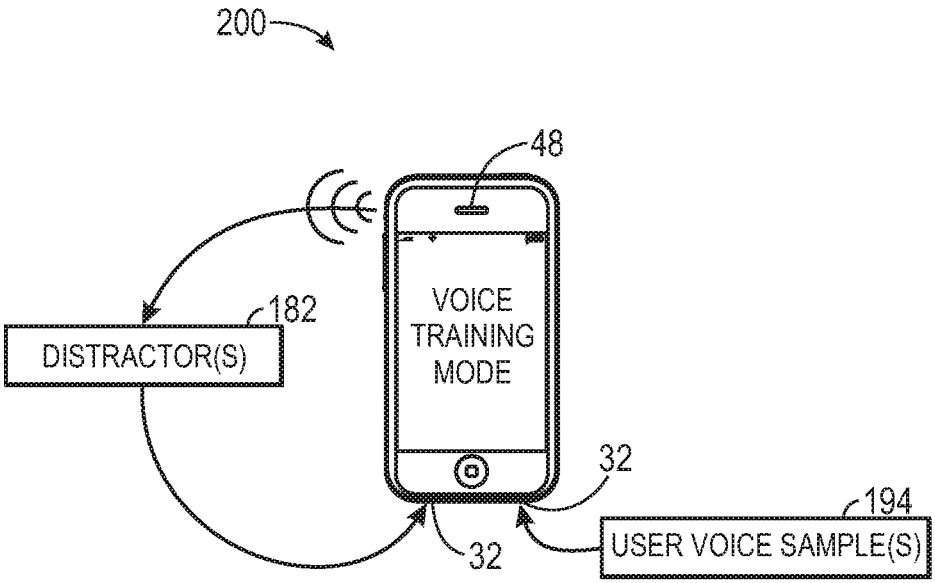

In another embodiment, represented by a single-device voice recording system 200 of FIG. 11, the handheld device 34 may both output distractor(s) 182 and record a user voice sample 194 at the same time. As shown in FIG. 11, the handheld device 34 may prompt a user to say a word or phrase for the user voice sample 194. At the same time, a speaker 48 of the handheld device 34 may output one or more distractors 182. The microphone 32 of the handheld device 34 then may record a test audio signal that includes both a currently playing distractor 182 and a user voice sample 194 without the computer or other electronic device 132.

Figure 12:
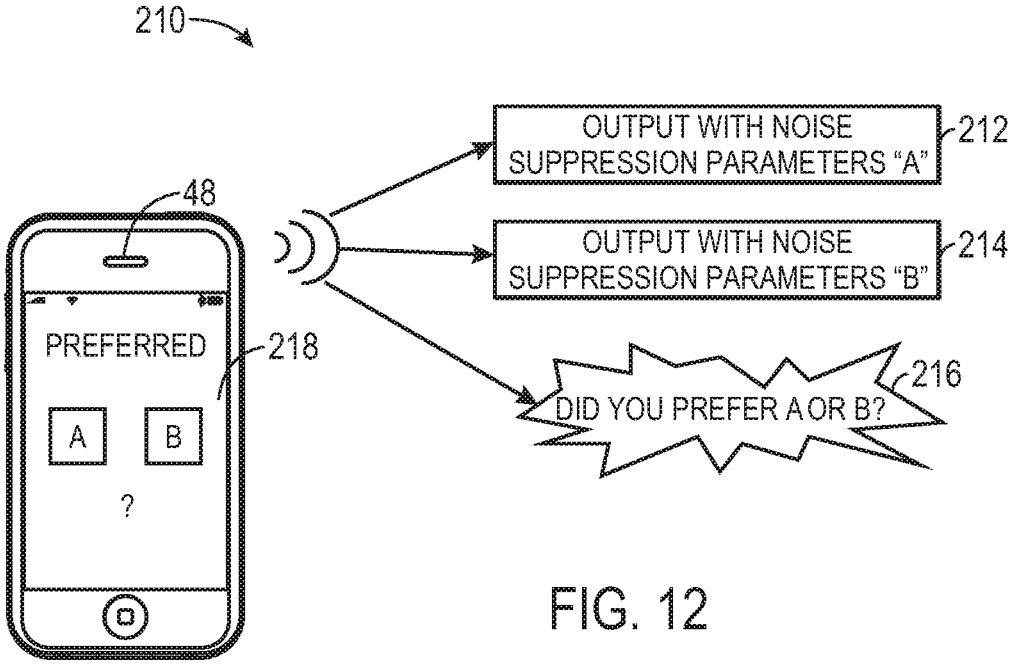
FIG. 12 is a schematic diagram illustrating a manner of obtaining a noise suppression user preference during a voice training sequence, in accordance with an embodiment.

Corresponding to blocks 166-170, FIG. 12 illustrates an embodiment for determining user's noise suppression preferences based on a choice of noise suppression parameters applied to a test audio signal. In particular, the electronic device 10, here represented as the handheld device 34, may apply a first set of noise suppression parameters ("A") to a test audio signal that includes both a user voice sample 194 and at least one distractor 182. The handheld device 34 may output the noise-suppressed audio signal that results (numeral 212). The handheld device 34 also may apply a second set of noise suppression parameters ("B") to the test audio signal before outputting the resulting noise-suppressed audio signal (numeral 214).

When the user has heard the result of applying the two sets of noise suppression parameters "A" and "B" to the test audio signal, the handheld device 34 may ask the user, for example, "Did you prefer A or B?" (numeral 216). The user then may indicate a noise suppression preference based on the output noise-suppressed signals. For example, the user may select either the first noise-suppressed audio signal ("A") or the second noise-suppressed audio signal ("B") via a screen 218 on the handheld device 34. In some embodiments, the user may indicate a preference in other manners, such as by saying "A" or "B" aloud.

Figure 13:
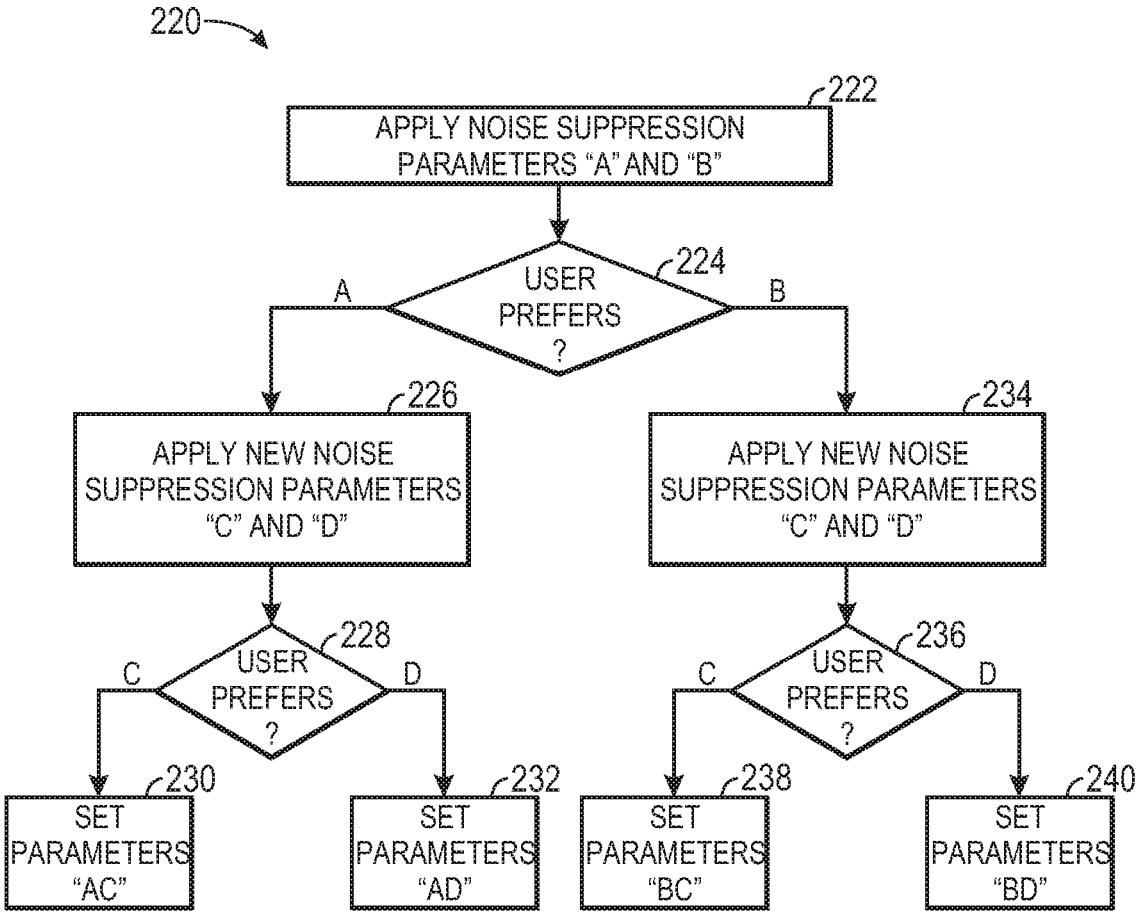
FIG. 13 is a flowchart describing an embodiment of a method for obtaining noise suppression user preferences during a voice training sequence.
Figure 14:
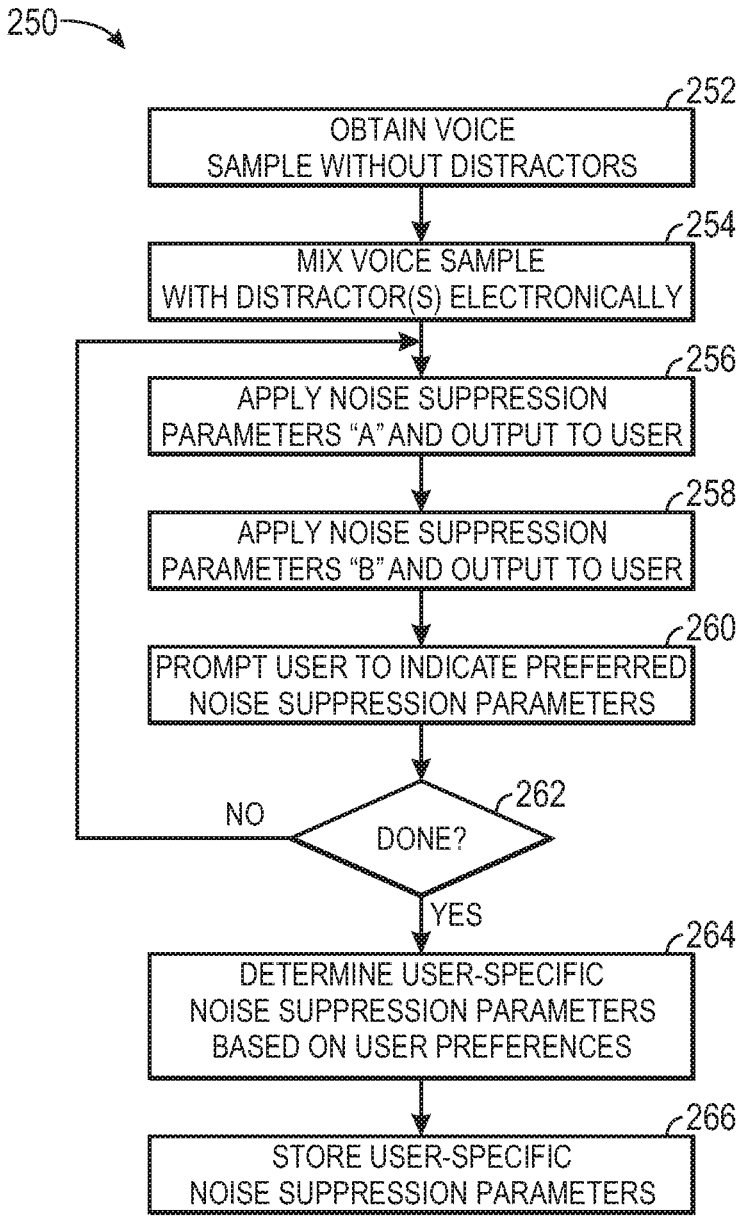
FIG. 14 is a flowchart describing an embodiment of another method for performing a voice training sequence.

The electronic device 10 may determine the user preferences for specific noise suppression parameters in a variety of manners. A flowchart 220 of FIG. 13 represents one embodiment of a method for performing blocks 166-172 of the flowchart 160 of FIG. 9. The flowchart 220 may begin when the electronic device 10 applies a set of noise suppression parameters that, for exemplary purposes, are labeled "A" and "B". If the user prefers the noise suppression parameters "A" (decision block 224), the electronic device 10 may next apply new sets of noise suppression parameters that, for similarly descriptive purposes are labeled "C" and "D" (block 226). In certain embodiments, the noise suppression parameters "C" and "D" may be variations of the noise suppression parameters "A." If a user prefers the noise suppression parameters "C" (decision block 228), the electronic device may set the noise suppression parameters to be a combination of "A" and "C" (block 230). If the user prefers the noise suppression parameters "D" (decision block 228), the electronic device may set the user-specific noise suppression parameters to be a combination of the noise suppression parameters "A" and "D" (block 232).

If, after block 222, the user prefers the noise suppression parameters "B" (decision block 224), the electronic device 10 may apply the new noise suppression parameters "C" and "D" (block 234). In certain embodiments, the new noise suppression parameters "C" and "D" may be variations of the noise suppression parameters "B". If the user prefers the noise suppression parameters "C" (decision block 236), the electronic device 10 may set the user-specific noise suppression parameters to be a combination of "B" and "C" (block 238). Otherwise, if the user prefers the noise suppression parameters "D"(decision block 236), the electronic device 10 may set the user-specific noise suppression parameters to be a combination of "B" and "D" (block 240). As should be appreciated, the flowchart 220 is presented as only one manner of performing blocks 166-172 of the flowchart 160 of FIG. 9. Accordingly, it should be understood that many more noise suppression parameters may be tested, and such parameters may be tested specifically in conjunction with certain distractors (e.g., in certain embodiments, the flowchart 220 may be repeated for test audio signals that respectively include each of the distractors 182).

The voice training sequence 104 may be performed in other ways. For example, in one embodiment represented by a flowchart 250 of FIG. 14, a user voice sample 194 first may be obtained without any distractors 182 playing in the background (block 252). In general, such a user voice sample 194 may be obtained in a location with very little ambient sounds 60, such as a quiet room, so that the user voice sample 194 has a relatively high signal-to-noise ratio (SNR). Thereafter, the electronic device 10 may mix the user voice sample 194 with the various distractors 182 electronically (block 254). Thus, the electronic device 10 may produce one or more test audio signals having a variety of distractors 182 using a single user voice sample 194.

Thereafter, the electronic device 10 may determine which noise suppression parameters a user most prefers to determine the user-specific noise suppression parameters 102. In a manner similar to blocks 166-170 of FIG. 9, the electronic device 10 may alternatingly apply certain test noise suppression parameters to the test audio signals obtained at block 254 to gauge user preferences (blocks 256-260). The electronic device 10 may repeat the actions of blocks 256-260 with various test noise suppression parameters and with various distractors, learning more about the user's noise suppression preferences each time until a suitable set of user noise suppression preference data has been obtained (decision block 262). Thus, the electronic device 10 may test the desirability of a variety of noise suppression parameters as applied to a test audio signal containing the user's voice as well as certain common ambient sounds.

Like block 174 of FIG. 9, the electronic device 10 may develop user-specific noise suppression parameters 102 (block 264). The user-specific noise suppression parameters 102 may be stored in the memory 14 or the nonvolatile storage 16 of the electronic device 10 (block 266) for noise suppression when the same user later uses a voice-related feature of the electronic device 10.

As mentioned above, certain embodiments of the present disclosure may involve obtaining a user voice sample 194 without distractors 182 playing aloud in the background. In some embodiments, the electronic device 10 may obtain such a user voice sample 194 the first time that the user uses a voice-related feature of the electronic device 10 in a quiet setting without disrupting the user. As represented in a flowchart 270 of FIG. 15, in some embodiments, the electronic device 10 may obtain such a user voice sample 194 when the electronic device 10 first detects a sufficiently high signal-to-noise ratio (SNR) of audio containing the user's voice.

Figure 15:
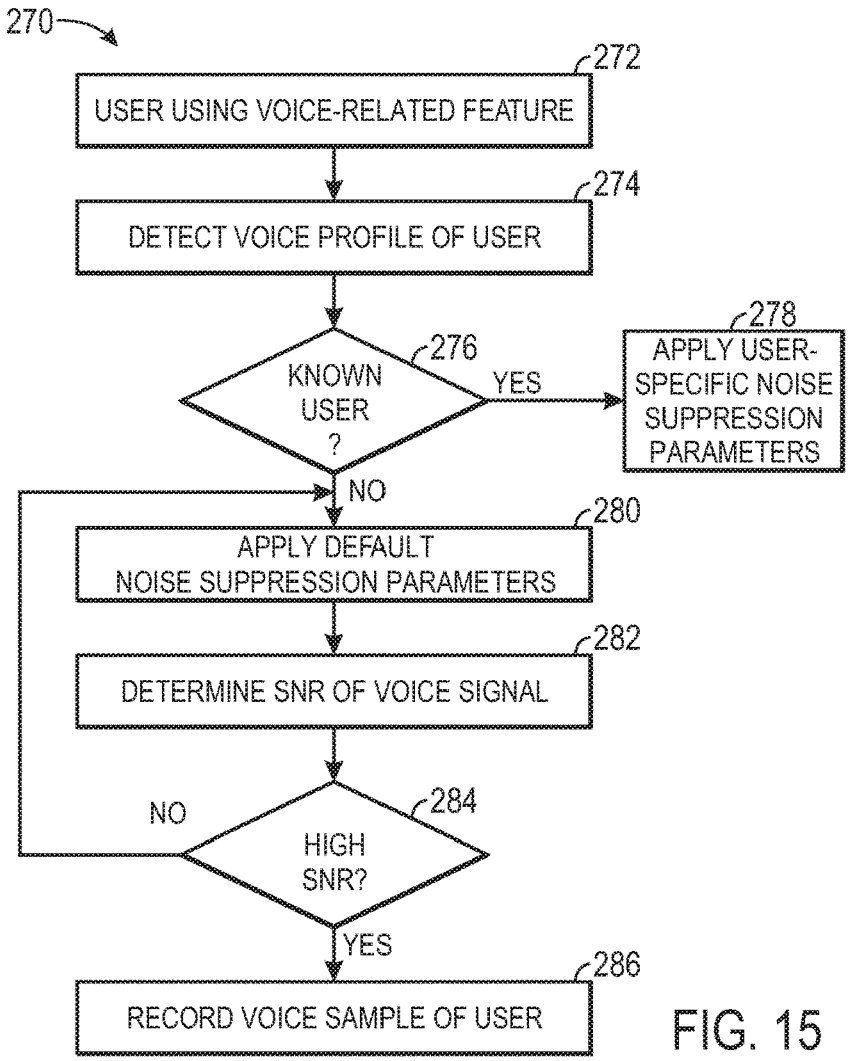
FIG. 15 is a flowchart describing an embodiment of a method for obtaining a high signal-to-noise ratio (SNR) user voice sample.

The flowchart 270 of FIG. 15 may begin when a user is using a voice-related feature of the electronic device 10 (block 272). To ascertain an identity of the user, the electronic device 10 may detect a voice profile of the user based on an audio signal detected by the microphone 32 (block 274). If the voice profile detected in block 274 represents the voice profile of the voice of a known user of the electronic device (decision block 276), the electronic device 10 may apply the user-specific noise suppression parameters 102 associated with that user (block 278). If the user's identity is unknown (decision block 276), the electronic device 10 may initially apply default noise suppression parameters (block 280).

The electronic device 10 may assess the current signal-to-noise ration (SNR) of the audio signal received by the microphone 32 while the voice-related feature is being used (block 282). If the SNR is sufficiently high (e.g., above a preset threshold), the electronic device 10 may obtain a user voice sample 194 from the audio received by the microphone 32 (block 286). If the SNR is not sufficiently high (e.g., below the threshold) (decision block 284), the electronic device 10 may continue to apply the default noise suppression parameters (block 280), continuing to at least periodically reassess the SNR. A user voice sample 194 obtained in this manner may be later employed in the voice training sequence 104 as discussed above with reference to FIG. 14. In other embodiments, the electronic device 10 may employ such a user voice sample 194 to determine the user-specific noise suppression parameters 102 based on the user voice sample 194 itself.

Figure 16:
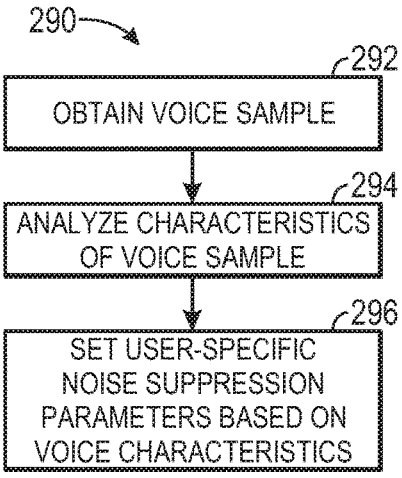
FIG. 16 is a flowchart describing an embodiment of a method for determining user-specific noise suppression parameters via analysis of a user voice sample.

Specifically, in addition to the voice training sequence 104, the user-specified noise suppression parameters 102 may be determined based on certain characteristics associated with a user voice sample 194. For example, FIG. 16 represents a flowchart 290 for determining the user-specific noise suppression parameters 102 based on such user voice characteristics. The flowchart 290 may begin when the electronic device 10 obtains a user voice sample 194 (block 292). The user voice sample may be obtained, for example, according to the flowchart 270 of FIG. 15 or may be obtained when the electronic device 10 prompts the user to say a specific word or phrase. The electronic device next may analyze certain characteristics associated with the user voice sample (block 294).

Based on the various characteristics associated with the user voice sample 194, the electronic device 10 may determine the user-specific noise suppression parameters 102 (block 296). For example, as shown by a voice characteristic diagram 300 of FIG. 17, a user voice sample 194 may include a variety of voice sample characteristics 302. Such characteristics 302 may include, among other things, an average frequency 304 of the user voice sample 194, a variability of the frequency 306 of the user voice sample 194, common speech sounds 308 associated with the user voice sample 194, a frequency range 310 of the user voice sample 194, formant locations 312 in the frequency of the user voice sample, and/or a dynamic range 314 of the user voice sample 194. These characteristics may arise because different users may have different speech patterns. That is, the highness or deepness of a user's voice, a user's accent in speaking, and/or a lisp, and so forth, may be taken into consideration to the extent they change a measurable character of speech, such as the characteristics 302.

As mentioned above, the user-specific noise suppression parameters 102 also may be determined by a direct selection of user settings 108. One such example appears in FIG. 18 as a user setting screen sequence 320 for a handheld device 32. The screen sequence 320 may begin when the electronic device 10 displays a home screen 140 that includes a settings button 142. Selecting the settings button 142 may cause the handheld device 34 to display a settings screen 144. Selecting a user-selectable button 146 labeled "Phone" on the settings screen 144 may cause the handheld device 34 to display a phone settings screen 148, which may include various user-selectable buttons, one of which may be a user-selectable button 322 labeled "Noise Suppression."

When a user selects the user-selectable button 322, the handheld device 34 may display a noise suppression selection screen 324. Through the noise suppression selection screen 324, a user may select a noise suppression strength. For example, the user may select whether the noise suppression should be high, medium, or low strength via a selection wheel 326. Selecting a higher noise suppression strength may result in the user-specific noise suppression parameters 102 suppressing more ambient sounds 60, but possibly also suppressing more of the voice of the user 58, in a received audio signal. Selecting a lower noise suppression strength may result in the user-specific noise suppression parameters 102 permitting more ambient sounds 60, but also permitting more of the voice of the user 58, to remain in a received audio signal.

In other embodiments, the user may adjust the user-specific noise suppression parameters 102 in real time while using a voice-related feature of the electronic device 10. By way of example, as seen in a call-in-progress screen 330 of FIG. 19, which may be displayed on the handheld device 34, a user may provide a measure of voice phone call quality feedback 332. In certain embodiments, the feedback may be represented by a number of selectable stars 334 to indicate the quality of the call. If the number of stars 334 selected by the user is high, it may be understood that the user is satisfied with the current user-specific noise suppression parameters 102, and so the electronic device 10 may not change the noise suppression parameters. On the other hand, if the number of selected stars 334 is low, the electronic device 10 may vary the user-specific noise suppression parameters 102 until the number of stars 334 is increased, indicating user satisfaction. Additionally or alternatively, the call-in-progress screen 330 may include a real-time user-selectable noise suppression strength setting, such as that disclosed above with reference to FIG. 18.

Figure 20:
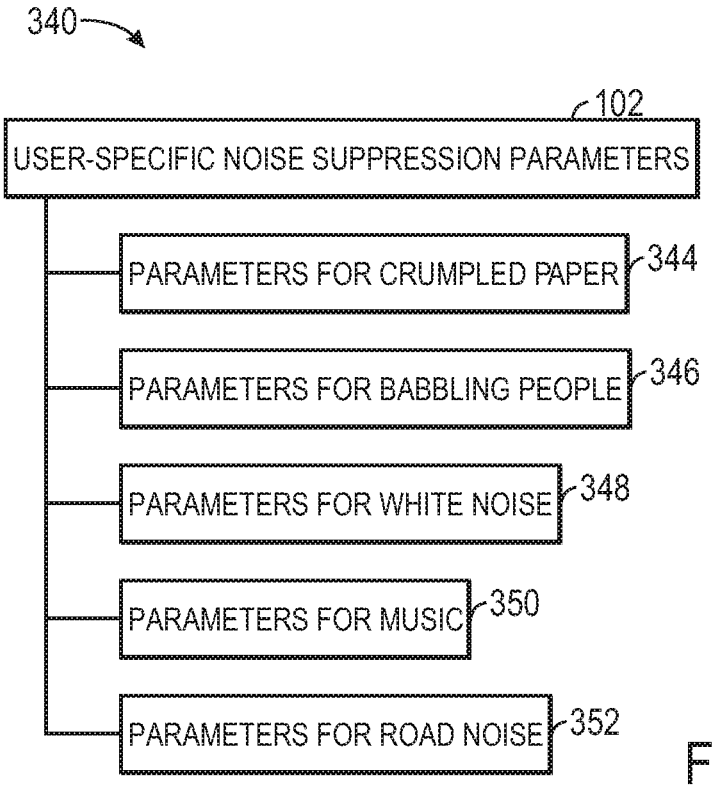
FIGS. 20 and 21 are schematic diagrams representing various sub-parameters that may form the user-specific noise suppression parameters, in accordance with an embodiment.

In certain embodiments, subsets of the user-specific noise suppression parameters 102 may be determined as associated with certain distractors 182 and/or certain contexts 60. As illustrated by a parameter diagram 340 of FIG. 20, the user-specific noise suppression parameters 102 may divided into subsets based on specific distractors 182. For example, the user-specific noise suppression parameters 102 may include distractor-specific parameters 344-352, which may represent noise suppression parameters chosen to filter certain ambient sounds 60 associated with a distractor 182 from an audio signal also including the voice of the user 58. It should be understood that the user-specific noise suppression parameters 102 may include more or fewer distractor-specific parameters. For example, if different distractors 182 are tested during voice training 104, the user-specific noise suppression parameters 102 may include different distractor-specific parameters.

The distractor-specific parameters 344-352 may be determined when the user-specific noise suppression parameters 102 are determined. For example, during voice training 104, the electronic device 10 may test a number of noise suppression parameters using test audio signals including the various distractors 182. Depending on a user's preferences relating to noise suppression for each distractor 182, the electronic device may determine the distractor-specific parameters 344-352. By way of example, the electronic device may determine the parameters for crumpled paper 344 based on a test audio signal that included the crumpled paper distractor 184. As described below, the distractor-specific parameters of the parameter diagram 340 may later be recalled in specific instances, such as when the electronic device 10 is used in the presence of certain ambient sounds 60 and/or in certain contexts 56.

Figure 21:
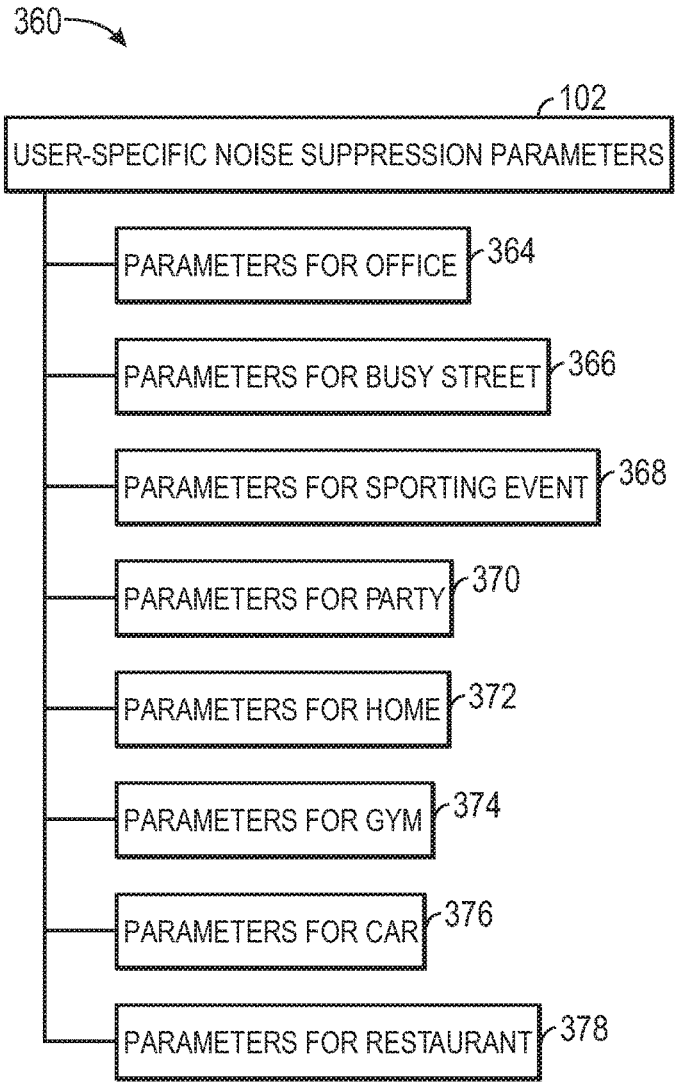

Additionally or alternatively, subsets of the user-specific noise suppression parameters 102 may be defined relative to certain contexts 56 where a voice-related feature of the electronic device 10 may be used. For example, as represented by a parameter diagram 360 shown in FIG. 21, the user-specific noise suppression parameters 102 may be divided into subsets based on which context 56 the noise suppression parameters may best be used. For example, the user-specific noise suppression parameters 102 may include context-specific parameters 364-378, representing noise suppression parameters chosen to filter certain ambient sounds 60 that may be associated with specific contexts 56. It should be understood that the user-specific noise suppression parameters 102 may include more or fewer context-specific parameters. For example, as discussed below, the electronic device 10 may be capable of identifying a variety of contexts 56, each of which may have specific expected ambient sounds 60. The user-specific noise suppression parameters 102 therefore may include different context-specific parameters to suppress noise in each of the identifiable contexts 56.

Like the distractor-specific parameters 344-352, the context-specific parameters 364-378 may be determined when the user-specific noise suppression parameters 102 are determined. To provide one example, during voice training 104, the electronic device 10 may test a number of noise suppression parameters using test audio signals including the various distractors 182. Depending on a user's preferences relating to noise suppression for each distractor 182, the electronic device 10 may determine the context-specific parameters 364-378.

The electronic device 10 may determine the context-specific parameters 364-378 based on the relationship between the contexts 56 of each of the context-specific parameters 364-378 and one or more distractors 182. Specifically, it should be noted that each of the contexts 56 identifiable to the electronic device 10 may be associated with one or more specific distractors 182. For example, the context 56 of being in a car 70 may be associated primarily with one distractor 182, namely, road noise 192. Thus, the context-specific parameters 376 for being in a car may be based on user preferences related to test audio signals that included road noise 192. Similarly, the context 56 of a sporting event 72 may be associated with several distractors 182, such as babbling people 186, white noise 188, and rock music 190. Thus, the context-specific parameters 368 for a sporting event may be based on a combination of user preferences related to test audio signals that included babbling people 186, white noise 188, and rock music 190. This combination may be weighted to more heavily account for distractors 182 that are expected to more closely match the ambient sounds 60 of the context 56.

As mentioned above, the user-specific noise suppression parameters 102 may be determined based on characteristics of the user voice sample 194 with or without the voice training 104 (e.g., as described above with reference to FIGS. 16 and 17). Under such conditions, the electronic device 10 may additionally or alternatively determine the distractor-specific parameters 344-352 and/or the context-specific parameters 364-378 automatically (e.g., without user prompting). These noise suppression parameters 344-352 and/or 363-378 may be determined based on the expected performance of such noise suppression parameters when applied to the user voice sample 194 and certain distractors 182.

Figure 22:
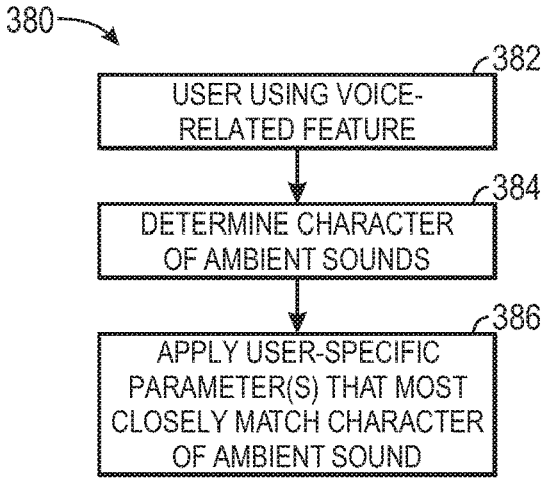
FIG. 22 is a flowchart describing an embodiment of a method for applying certain sub-parameters of the user-specific parameters based on detected ambient sounds.
Figure 23:
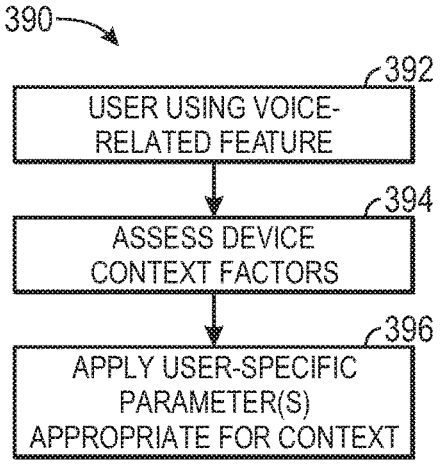
FIG. 23 is a flowchart describing an embodiment of a method for applying certain sub-parameters of the noise suppression parameters based on a context of use of the electronic device.

When a voice-related feature of the electronic device 10 is in use, the electronic device 10 may tailor the noise suppression 20 both to the user and to the character of the ambient sounds 60 using the distractor-specific parameters 344-352 and/or the context-specific parameters 364-378. Specifically, FIG. 22 illustrates an embodiment of a method for selecting and applying the distractor-specific parameters 344-352 based on the assessed character of ambient sounds 60. FIG. 23 illustrates an embodiment of a method for selecting and applying the context-specific parameters 364-378 based on the identified context 56 where the electronic device 10 is used.

Turning to FIG. 22, a flowchart 380 for selecting and applying the distractor-specific parameters 344-352 may begin when a voice-related feature of the electronic device 10 is in use (block 382). Next, the electronic device 10 may determine the character of the ambient sounds 60 received by its microphone 32 (block 384). In some embodiments, the electronic device 10 may differentiate between the ambient sounds 60 and the user's voice 58, for example, based on volume level (e.g., the user's voice 58 generally may be louder than the ambient sounds 60) and/or frequency (e.g., the ambient sounds 60 may occur outside of a frequency range associated with the user's voice 58).

The character of the ambient sounds 60 may be similar to one or more of the distractors 182. Thus, in some embodiments, the electronic device 10 may apply the one of the distractor-specific parameters 344-352 that most closely match the ambient sounds 60 (block 386). For the context 56 of being at a restaurant 74, for example, the ambient sounds 60 detected by the microphone 32 may most closely match babbling people 186. The electronic device 10 thus may apply the distractor-specific parameter 346 when such ambient sounds 60 are detected. In other embodiments, the electronic device 10 may apply several of the distractor-specific parameters 344-352 that most closely match the ambient sounds 60. These several distractor-specific parameters 344-352 may be weighted based on the similarity of the ambient sounds 60 to the corresponding distractors 182. For example, the context 56 of a sporting event 72 may have ambient sounds 60 similar to several distractors 182, such as babbling people 186, white noise 188, and rock music 190. When such ambient sounds 60 are detected, the electronic device 10 may apply the several associated distractor-specific parameters 346, 348, and/or 350 in proportion to the similarity of each to the ambient sounds 60.

In a similar manner, the electronic device 10 may select and apply the context-specific parameters 364-378 based on an identified context 56 where the electronic device 10 is used. Turning to FIG. 23, a flowchart 390 for doing so may begin when a voice-related feature of the electronic device 10 is in use (block 392). Next, the electronic device 10 may determine the current context 56 in which the electronic device 10 is being used (block 394). Specifically, the electronic device 10 may consider a variety of device context factors (discussed in greater detail below with reference to FIG. 24). Based on the context 56 in which the electronic device 10 is determined to be in use, the electronic device 10 may apply the associated one of the context-specific parameters 364-378 (block 396).

Figure 24:
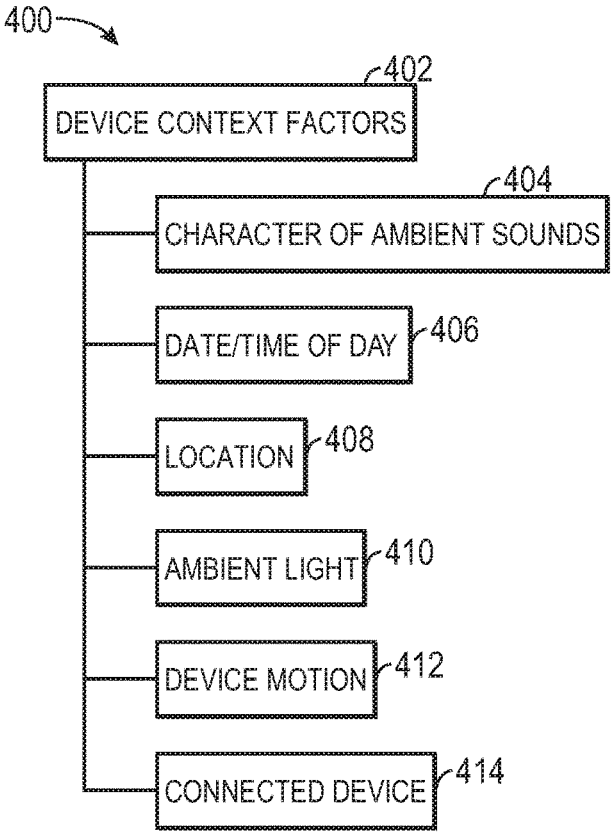
FIG. 24 is a factor diagram representing a variety of device context factors that may be employed in the method of FIG. 23, in accordance with an embodiment.

As shown by a device context factor diagram 400 of FIG. 24, the electronic device 10 may consider a variety of device context factors 402 to identify the current context 56 in which the electronic device 10 is being used. These device context factors 402 may be considered alone or in combination in various embodiments and, in some cases, the device context factors 402 may be weighted. That is, device context factors 402 more likely to correctly predict the current context 56 may be given more weight in determining the context 56, while device context factors 402 less likely to correctly predict the current context 56 may be given less weight.

For example, a first factor 404 of the device context factors 402 may be the character of the ambient sounds 60 detected by the microphone 32 of the electronic device 10. Since the character of the ambient sounds 60 may relate to the context 56, the electronic device 10 may determine the context 56 based at least partly on such an analysis.

A second factor 406 of the device context factors 402 may be the current date or time of day. In some embodiments, the electronic device 10 may compare the current date and/or time with a calendar feature of the electronic device 10 to determine the context. By way of example, if the calendar feature indicates that the user is expected to be at dinner, the second factor 406 may weigh in favor of determining the context 56 to be a restaurant 74. In another example, since a user may be likely to commute in the morning or late afternoon, at such times the second factor 406 may weigh in favor of determining the context 56 to be a car 70.

A third factor 408 of the device context factors 402 may be the current location of the electronic device 10, which may be determined by the location-sensing circuitry 22. Using the third factor 408, the electronic device 10 may consider its current location in determining the context 56 by, for example, comparing the current location to a known location in a map feature of the electronic device 10 (e.g., a restaurant 74 or office 64) or to locations where the electronic device 10 is frequently located (which may indicate, for example, an office 64 or home 62).

A fourth factor 410 of the device context factors 402 may be the amount of ambient light detected around the electronic device 10 via, for example, the image capture circuitry 28 of the electronic device. By way of example, a high amount of ambient light may be associated with certain contexts 56 located outdoors (e.g., a busy street 68). Under such conditions, the factor 410 may weigh in favor of a context 56 located outdoors. A lower amount of ambient light, by contrast, may be associated with certain contexts 56 located indoors (e.g., home 62), in which case the factor 410 may weigh in favor of such an indoor context 56.

A fifth factor 412 of the device context factors 402 may be detected motion of the electronic device 10. Such motion may be detected based on the accelerometers and/or magnetometer 30 and/or based on changes in location over time as determined by the location-sensing circuitry 22. Motion may suggest a given context 56 in a variety of ways. For example, when the electronic device 10 is detected to be moving very quickly (e.g., faster than 20 miles per hour), the factor 412 may weigh in favor of the electronic device 10 being in a car 70 or similar form of transportation. When the electronic device 10 is moving randomly, the factor 412 may weigh in favor of contexts in which a user of the electronic device 10 may be moving about (e.g., at a gym 66 or a party 76). When the electronic device 10 is mostly stationary, the factor 412 may weigh in favor of contexts 56 in which the user is seated at one location for a period of time (e.g., an office 64 or restaurant 74).

A sixth factor 414 of the device context factors 402 may be a connection to another device (e.g., a Bluetooth handset). For example, a Bluetooth connection to an automotive hands-free phone system may cause the sixth factor 414 to weigh in favor of determining the context 56 to be in a car 70.

In some embodiments, the electronic device 10 may determine the user-specific noise suppression parameters 102 based on a user voice profile associated with a given user of the electronic device 10. The resulting user-specific noise suppression parameters 102 may cause the noise suppression 20 to isolate ambient sounds 60 that do not appear associated with the user voice profile, and thus may be understood to likely be noise. FIGS. 25-29 relate to such techniques.

Figure 25:
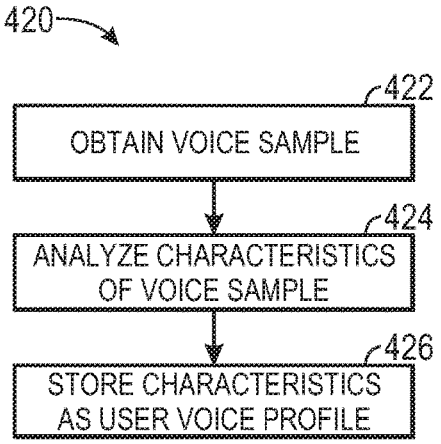
FIG. 25 is a flowchart describing an embodiment of a method for obtaining a user voice profile.
Figure 26:
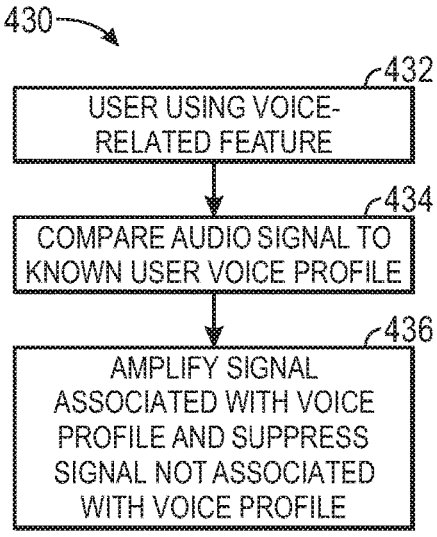
FIG. 26 is a flowchart describing an embodiment of a method for applying noise suppression based on a user voice profile.

As shown in FIG. 25, a flowchart 420 for obtaining a user voice profile may begin when the electronic device 10 obtains a voice sample (block 422). Such a voice sample may be obtained in any of the manners described above. The electronic device 10 may analyze certain of the characteristics of the voice sample, such as those discussed above with reference to FIG. (block 424). The specific characteristics may be quantified and stored as a voice profile of the user (block 426). The determined user voice profile may be employed to tailor the noise suppression 20 to the user's voice, as discussed below. In addition, the user voice profile may enable the electronic device 10 to identify when a particular user is using a voice-related feature of the electronic device 10, such as discussed above with reference to FIG. 15.

With such a voice profile, the electronic device 10 may perform the noise suppression 20 in a manner best applicable to that user's voice. In one embodiment, as represented by a flowchart 430 of FIG. 26, the electronic device 10 may suppress frequencies of an audio signal that more likely correspond to ambient sounds 60 than a voice of a user 58, while enhancing frequencies more likely to correspond to the voice signal 58. The flowchart 430 may begin when a user is using a voice-related feature of the electronic device 10 (block 432). The electronic device 10 may compare an audio signal received that includes both a user voice signal 58 and ambient sounds 60 to a user voice profile associated with the user currently speaking into the electronic device 10 (block 434). To tailor the noise suppression 20 to the user's voice, the electronic device may perform noise suppression 20 in a manner that suppresses frequencies of the audio signal that are not associated with the user voice profile and by amplifying frequencies of the audio signal that are associated with the user voice profile (block 436).

Figure 27:
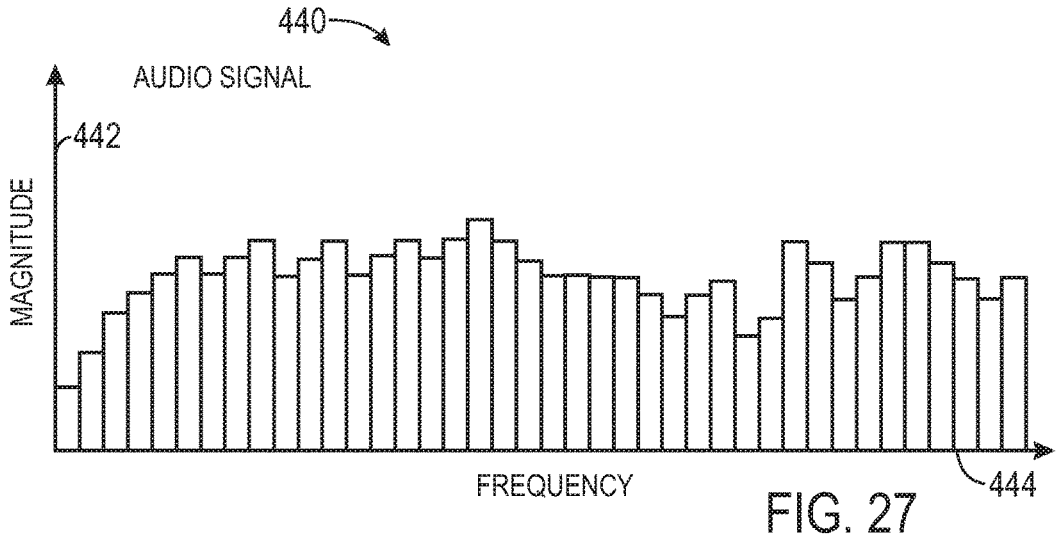
FIGS. 27-29 are plots depicting a manner of performing noise suppression of an audio signal based on a user voice profile, in accordance with an embodiment.
Figure 28:
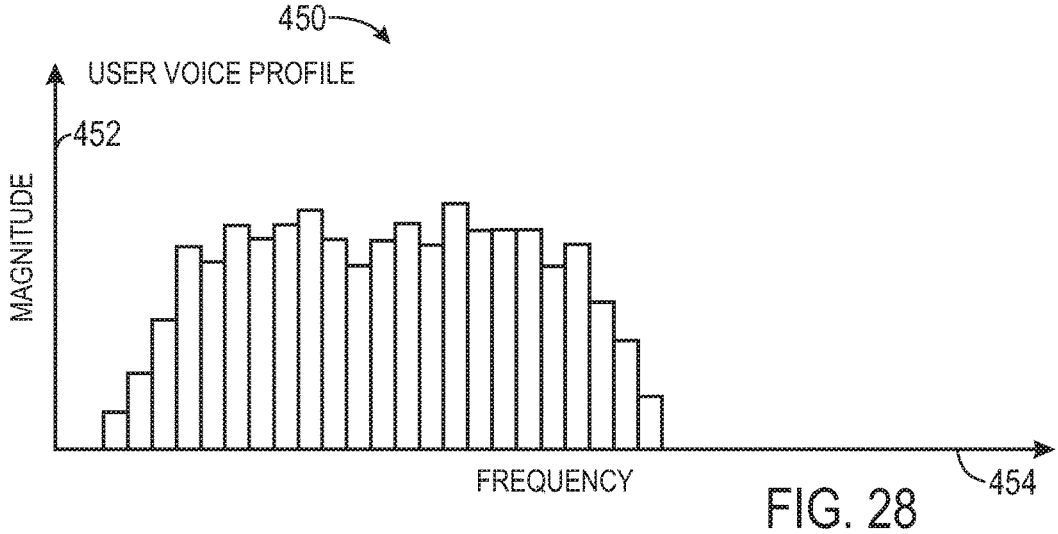
Figure 29:
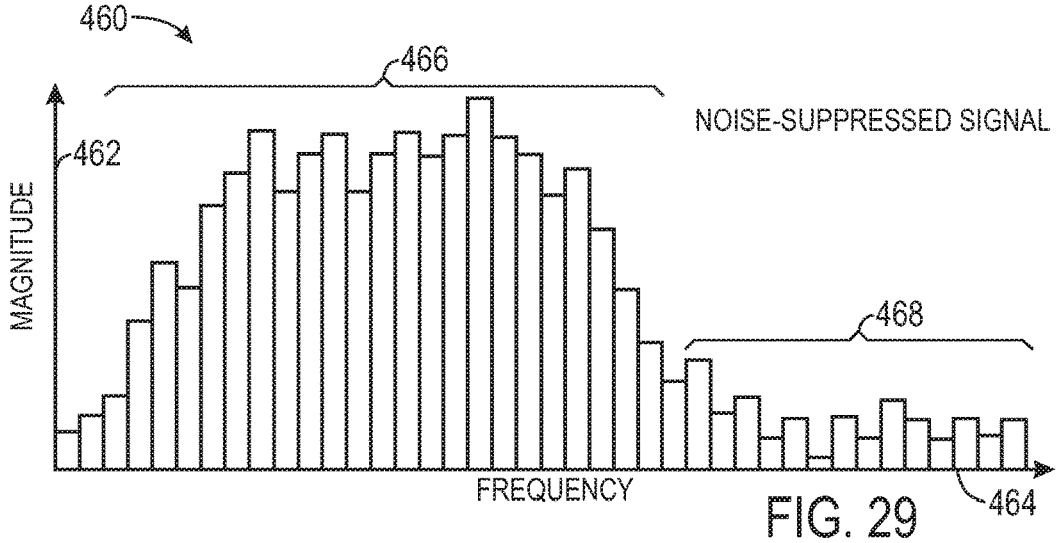

One manner of doing so is shown through FIGS. 27-29, which represent plots modeling an audio signal, a user voice profile, and an outgoing noise-suppressed signal. Turning to FIG. 27, a plot 440 represents an audio signal that has been received into the microphone 32 of the electronic device 10 while a voice-related feature is in use and transformed into the frequency domain. An ordinate 442 represents a magnitude of the frequencies of the audio signal and an abscissa 444 represents various discrete frequency components of the audio signal. It should be understood that any suitable transform, such as a fast Fourier transform (FFT), may be employed to transform the audio signal into the frequency domain. Similarly, the audio signal may be divided into any suitable number of discrete frequency components (e.g., 40, 128, 256, etc.).

By contrast, a plot 450 of FIG. 28 is a plot modeling frequencies associated with a user voice profile. An ordinate 452 represents a magnitude of the frequencies of the user voice profile and an abscissa 454 represents discrete frequency components of the user voice profile. Comparing the audio signal plot 440 of FIG. 27 to the user voice profile plot 450 of FIG. 28, it may be seen that the modeled audio signal includes range of frequencies not typically associated with the user voice profile. That is, the modeled audio signal may be likely to include other ambient sounds 60 in addition to the user's voice.

From such a comparison, when the electronic device 10 carries out noise suppression 20, it may determine or select the user-specific noise suppression parameters 102 such that the frequencies of the audio signal of the plot 440 that correspond to the frequencies of the user voice profile of the plot 450 are generally amplified, while the other frequencies are generally suppressed. Such a resulting noise-suppressed audio signal is modeled by a plot 460 of FIG. 29. An ordinate 462 of the plot 460 represents a magnitude of the frequencies of the noise-suppressed audio signal and an abscissa 464 represents discrete frequency components of the noise-suppressed signal. An amplified portion 466 of the plot 460 generally corresponds to the frequencies found in the user voice profile. By contrast, a suppressed portion 468 of the plot 460 corresponds to frequencies of the noise-suppressed signal that are not associated with the user profile of plot 450. In some embodiments, a greater amount of noise suppression may be applied to frequencies not associated with the user voice profile of plot 450, while a lesser amount of noise suppression may be applied to the portion 466, which may or may not be amplified.

The above discussion generally focused on determining the user-specific noise suppression parameters 102 for performing the TX NS 84 of the noise suppression 20 on an outgoing audio signal, as shown in FIG. 4. However, as mentioned above, the user-specific noise suppression parameters 102 also may be used for performing the RX NS 92 on an incoming audio signal from another device. Since such an incoming audio signal from another device will not include the user's own voice, in certain embodiments, the user-specific noise suppression parameters 102 may be determined based on voice training 104 that involves several test voices in addition to several distractors 182.

Figure 30:
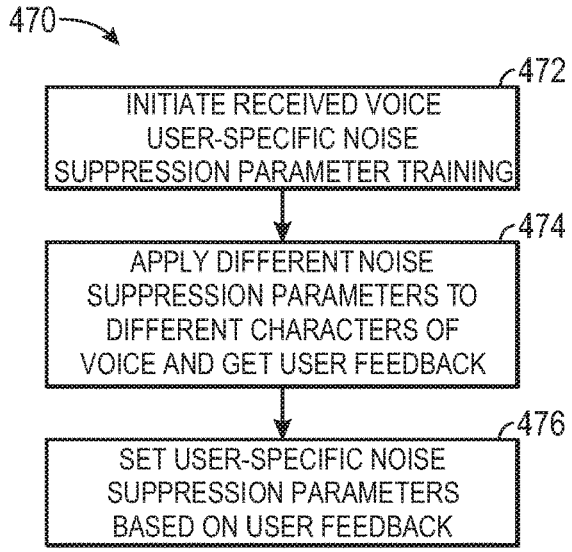
FIG. 30 is a flowchart describing an embodiment of a method for obtaining user-specific noise suppression parameters via a voice training sequence involving per-recorded voices.

For example, as presented by a flowchart 470 of FIG. 30, the electronic device 10 may determine the user-specific noise suppression parameters 102 via voice training 104 involving pre-recorded or simulated voices and simulated distractors 182. Such an embodiment of the voice training 104 may involve test audio signals that include a variety of difference voices and distractors 182. The flowchart 470 may begin when a user initiates voice training 104 (block 472). Rather than perform the voice training 104 based solely on the user's own voice, the electronic device 10 may apply various noise suppression parameters to various test audio signals containing various voices, one of which may be the user's voice in certain embodiments (block 474). Thereafter, the electronic device 10 may ascertain the user's preferences for different noise suppression parameters tested on the various test audio signals. As should be appreciated, block 474 may be carried out in a manner similar to blocks 166-170 of FIG. 9.

Figure 31:
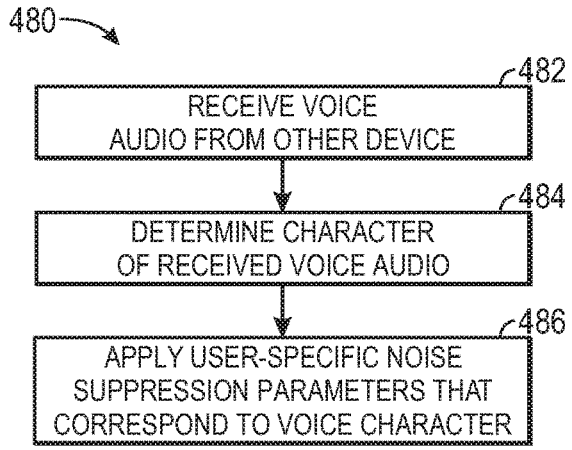
FIG. 31 is a flowchart describing an embodiment of a method for applying user-specific noise suppression parameters to audio received from another electronic device.

Based on the feedback from the user at block 474, the electronic device 10 may develop user-specific noise suppression parameters 102 (block 476). The user-specific parameters 102 developed based on the flowchart 470 of FIG. 30 may be well suited for application to a received audio signal (e.g., used to form the RX NS parameters 94, as shown in FIG. 4). In particular, a received audio signal will includes different voices when the electronic device 10 is used as a telephone by a "near-end" user to speak with "far-end" users. Thus, as shown by a flowchart 480 of FIG. 31, the user-specific noise suppression parameters 102, determined using a technique such as that discussed with reference to FIG. 30, may be applied to the received audio signal from a far-end user depending on the character of the far-end user's voice in the received audio signal.

The flowchart 480 may begin when a voice-related feature of the electronic device 10, such as a telephone or chat feature, is in use and is receiving an audio signal from another electronic device 10 that includes a far-end user's voice (block 482). Subsequently, the electronic device 10 may determine the character of the far-end user's voice in the audio signal (block 484). Doing so may entail, for example, comparing the far-end user's voice in the received audio signal with certain other voices that were tested during the voice training 104 (when carried out as discussed above with reference to FIG. 30). The electronic device 10 next may apply the user-specific noise suppression parameters 102 that correspond to one of the other voices that is most similar to the end-user's voice (block 486).

In general, when a first electronic device 10 receives an audio signal containing a far-end user's voice from a second electronic device 10 during two-way communication, such an audio signal already may have been processed for noise suppression in the second electronic device 10. According to certain embodiments, such noise suppression in the second electronic device 10 may be tailored to the near-end user of the first electronic 10, as described by a flowchart 490 of FIG. 32. The flowchart 490 may begin when the first electronic device 10 (e.g., handheld device 34A of FIG. 33) is or is about to begin receiving an audio signal of the far-end user's voice from the second electronic device 10 (e.g., handheld device 34B) (block 492). The first electronic device 10 may transmit the user-specific noise suppression parameters 102, previously determined by the near-end user, to the second electronic device 10 (block 494). Thereafter, the second electronic device 10 may apply those user-specific noise suppression parameters 102 toward the noise suppression of the far-end user's voice in the outgoing audio signal (block 496). Thus, the audio signal including the far-end user's voice that is transmitted from the second electronic device 10 to the first electronic device 10 may have the noise-suppression characteristics preferred by the near-end user of the first electronic device 10.

Figure 32:
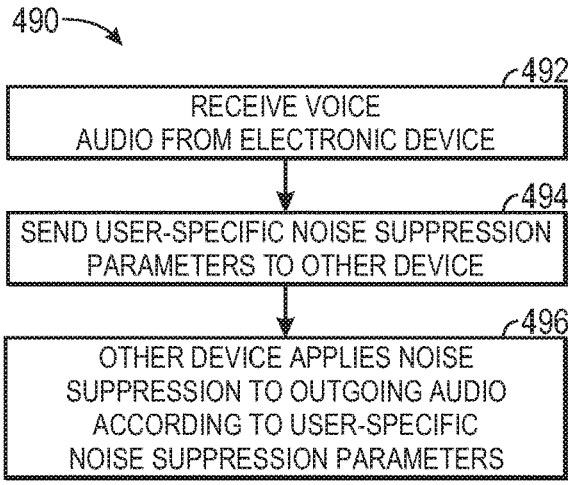
FIG. 32 is a flowchart describing an embodiment of a method for causing another electronic device to engage in noise suppression based on the user-specific noise parameters of a first electronic device, in accordance with an embodiment.
Figure 33:
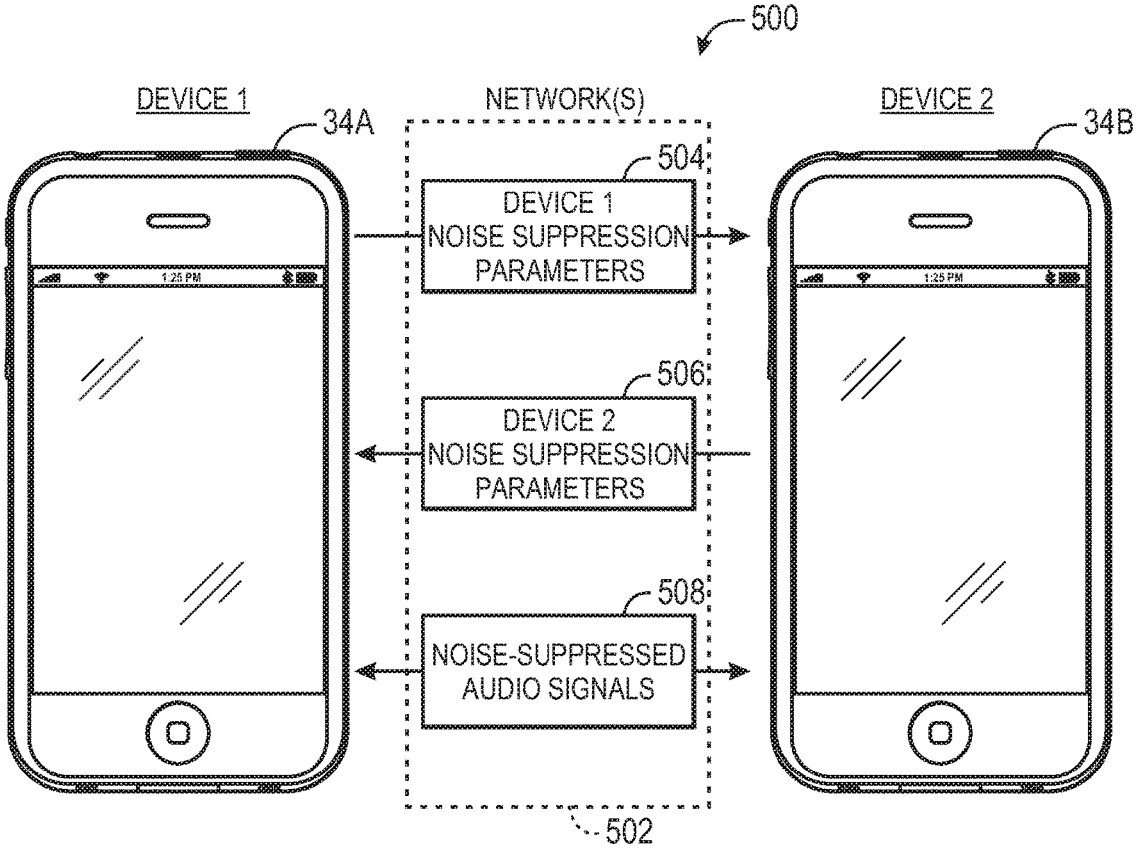
FIG. 33 is a schematic block diagram of a system for performing noise suppression on two electronic devices based on user-specific noise suppression parameters associated with the other electronic device, in accordance with an embodiment.

The above-discussed technique of FIG. 32 may be employed systematically using two electronic devices 10, illustrated as a system 500 of FIG. 33 including handheld devices 34A and 34B with similar noise suppression capabilities. When the handheld devices 34A and 34B are used for intercommunication by a near-end user and a far-end user respectively over a network (e.g., using a telephone or chat feature), the handheld devices 34A and 34B may exchange the user-specific noise suppression parameters 102 associated with their respective users (blocks 504 and 506). That is, the handheld device 34B may receive the user-specific noise suppression parameters 102 associated with the near-end user of the handheld device 34A. Likewise, the handheld device 34A may receive the user-specific noise suppression parameters 102 associated with the far-end user of the handheld device 34B. Thereafter, the handheld device 34A may perform noise suppression 20 on the near-end user's audio signal based on the far-end user's user-specific noise suppression parameters 102. Likewise, the handheld device 34B may perform noise suppression 20 on the far-end user's audio signal based on the near-end user's user-specific noise suppression parameters 102. In this way, the respective users of the handheld devices 34A and 34B may hear audio signals from the other whose noise suppression matches their respective preferences.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method, comprising:

at an electronic device with one or more processors and memory:

receiving an audio signal that includes a voice of a near-end user of the electronic device when a voice-related feature of the electronic device is in use;

suppressing noise in the audio signal using the electronic device while substantially preserving the voice of the near-end user based at least in part on user-specific noise suppression parameters, wherein the user-specific noise suppression parameters are based at least in part on a user noise suppression preference, wherein the user noise suppression preference is based on a user selection between a first filtered audio signal generated by applying a first set of noise suppression parameters to a test audio signal and a second filtered audio signal generated by applying a second set of noise suppression parameters to the test audio signal, and wherein the test audio signal includes speech of the near-end user and one or more distracters, the test audio signal being output by the electronic device responsive to receiving a user input indicating initiation of a voice training mode of the electronic device; and transmitting the audio signal to a remote device for receipt by a far-end user.

2. The method of claim 1, wherein the user-specific noise suppression parameters suppress noise in the audio signal while substantially preserving the voice at least in part by amplifying frequencies associated with a user voice profile.

3. The method of claim 1, wherein the user-specific noise suppression parameters suppress noise in the audio signal while substantially preserving the voice at least in part by suppressing frequencies not associated with a user voice profile.

4. The method of claim 1, wherein a first noise suppression strength associated with the first set of noise suppression parameters is greater than a second noise suppression strength associated with the second set of noise suppression parameters.

5. The method of claim 1, further comprising:

determining a user voice profile based on the audio signal; and determining the user-specific noise suppression parameters based on the user voice profile.

6. The method of claim 1, further comprising:

adjusting the user-specific noise suppression parameters based on user input received while receiving the audio signal.

7. The method of claim 1, wherein the first filtered audio signal is generated after applying a third set of noise suppression parameters to the test audio signal and wherein the second filtered audio signal is generated after applying a fourth set of noise suppression parameters to the test audio signal.

8. The method of claim 1, wherein the user selection includes a selection of a displayed menu item.

9. The method of claim 1, wherein the user selection is responsive to a prompt, output by the electronic device, prompting user selection between the first filtered audio signal and the second filtered audio signal.

10. The method of claim 1, wherein the user noise suppression preference is based at least in part on a user noise suppression training sequence.

11. The method of claim 10, wherein the user noise suppression training sequence comprises receiving at the electronic device a user selection of preferred noise parameters after noise suppression parameters have been tested on a second test audio signal and played back to the near-end user.

12. The method of claim 10, wherein the user noise suppression training sequence comprises testing noise suppression parameters as applied to a test audio signal that includes a voice sample of the near-end user and at least one distractor.

13. The method of claim 1, wherein the user noise suppression preference is further based on a user-selected noise suppression setting.

14. The method of claim 13, wherein the user-selected noise suppression setting comprises a noise suppression strength setting.

15. The method of claim 13, wherein the user-selected noise suppression setting is user selectable in real time while the voice-related feature of the electronic device is in use.

16. An electronic device, comprising:

one or more processors;

one or more microphones; and memory storing one or more programs for execution by the at least one processor, the one or more programs including instructions for:

receiving an audio signal that includes a voice of a near-end user of the electronic device when a voice-related feature of the electronic device is in use;

suppressing noise in the audio signal using the electronic device while substantially preserving the voice of the near-end user based at least in part on user-specific noise suppression parameters, wherein the user-specific noise suppression parameters are based at least in part on a user noise suppression preference, wherein the user noise suppression preference is based on a user selection between a first filtered audio signal generated by applying a first set of noise suppression parameters to a test audio signal and a second filtered audio signal generated by applying a second set of noise suppression parameters to the test audio signal, and wherein the test audio signal includes speech of the near-end user and one or more distractors, the test audio signal being output by the electronic device responsive to receiving a user input indicating initiation of a voice training mode of the electronic device; and transmitting the audio signal to a remote device for receipt by a far-end user.

17. The electronic device of claim 16, wherein the user noise suppression preference is further based on a user-selected noise suppression setting, and wherein the user-selected noise suppression setting is user selectable in real time while the voice-related feature of the electronic device is in use.

18. The electronic device of claim 16, wherein the user-specific noise suppression parameters suppress noise in the audio signal while substantially preserving the voice at least in part by amplifying frequencies associated with a user voice profile.

19. The electronic device of claim 16, wherein the user-specific noise suppression parameters suppress noise in the audio signal while substantially preserving the voice at least in part by suppressing frequencies not associated with a user voice profile.

20. The electronic device of claim 16, wherein the one or more programs further include instructions for:

determining a user voice profile based on the audio signal; and determining the user-specific noise suppression parameters based on the user voice profile.

21. The electronic device of claim 16, wherein the user selection is responsive to a prompt, output by the electronic device, prompting user selection between the first filtered audio signal and the second filtered audio signal.

22. A non-transitory computer-readable storage medium, storing one or more programs for execution by one or more processors of an electronic device, the one or more programs including instructions for:

receiving an audio signal that includes a voice of a near-end user of the electronic device when a voice-related feature of the electronic device is in use;

suppressing noise in the audio signal using the electronic device while substantially preserving the voice of the near-end user based at least in part on user-specific noise suppression parameters, wherein the user-specific noise suppression parameters are based at least in part on a user noise suppression preference, wherein the user noise suppression preference is based on a user selection between a first filtered audio signal generated by applying a first set of noise suppression parameters to a test audio signal and a second filtered audio signal generated by applying a second set of noise suppression parameters to the test audio signal, and wherein the test audio signal includes speech of the near-end user and one or more distracters, the test audio signal being output by the electronic device responsive to receiving a user input indicating initiation of a voice training mode of the electronic device; and transmitting the audio signal to a remote device for receipt by a far-end user.

23. The non-transitory computer-readable storage medium of claim 22, wherein the user noise suppression preference is further based on a user-selected noise suppression setting, and wherein the user-selected noise suppression setting is user selectable in real time while the voice-related feature of the electronic device is in use.

24. The non-transitory computer-readable storage medium of claim 22, wherein the user-specific noise suppression parameters suppress noise in the audio signal while substantially preserving the voice at least in part by amplifying frequencies associated with a user voice profile.

25. The non-transitory computer-readable storage medium of claim 22, wherein the user-specific noise suppression parameters suppress noise in the audio signal while substantially preserving the voice at least in part by suppressing frequencies not associated with a user voice profile.

26. The non-transitory computer-readable storage medium of claim 22, wherein the one or more programs further include instructions for:

determining a user voice profile based on the audio signal; and determining the user-specific noise suppression parameters based on the user voice profile.

27. The non-transitory computer-readable storage medium of claim 22, wherein the user selection is responsive to a prompt, output by the electronic device, prompting user selection between the first filtered audio signal and the second filtered audio signal.

28. An electronic device, comprising:

one or more processors;

one or more microphones; and memory storing one or more programs for execution by the one or more processors, the one or more programs including instructions for:

determining whether a signal-to-noise ratio of a first audio signal obtained while a voice-related feature of the electronic device is in use exceeds a threshold;

in accordance with a determination that the signal-to-noise ratio exceeds the threshold, obtaining a user voice sample from the first audio signal;

determining a user voice profile based at least in part on the user voice sample;

determining user-specific noise suppression parameters based at least in part on the user voice profile;

obtaining a second audio signal that includes a user voice and ambient sounds; and applying noise suppression to the second audio signal based at least in part on the user-specific noise suppression parameters to suppress the ambient sounds of the second audio signal.

29. The electronic device of claim 28, wherein the one or more programs further include instructions for:

determining the user voice profile further based at least in part on another user voice sample obtained during an activation period of the electronic device.

30. The electronic device of claim 28, wherein the one or more programs further include instructions for:

determining whether the user voice corresponds to a known user and, when the user voice corresponds to the known user, recalling the user voice profile associated with the user voice.

31. The electronic device of claim 28, wherein the one or more programs further include instructions for:

determining whether the user voice corresponds to a known user, wherein determining whether the signal-to-noise ratio of the first audio signal obtained while the voice-related feature of the electronic device is in use exceeds the threshold is performed in accordance with a determination that the user voice does not correspond to the known user.

32. A method, comprising:

at an electronic device with one or more processors and memory:

determining whether a signal-to-noise ratio of a first audio signal obtained while a voice-related feature of the electronic device is in use exceeds a threshold;

in accordance with a determination that the signal-to-noise ratio exceeds the threshold, obtaining a user voice sample from the first audio signal;

determining a user voice profile based at least in part on the user voice sample;

determining user-specific noise suppression parameters based at least in part on the user voice profile;

obtaining a second audio signal that includes a user voice and ambient sounds; and applying noise suppression to the second audio signal based at least in part on the user-specific noise suppression parameters to suppress the ambient sounds of the second audio signal.

33. The method of claim 32, further comprising:

determining the user voice profile further based at least in part on another user voice sample obtained during an activation period of the electronic device.

34. The method of claim 32, further comprising:

determining whether the user voice corresponds to a known user and, when the user voice corresponds to the known user, recalling the user voice profile associated with the user voice.

35. The method of claim 32, further comprising:

determining whether the user voice corresponds to a known user, wherein determining whether the signal-to-noise ratio of the first audio signal obtained while the voice-related feature of the electronic device is in use exceeds the threshold is performed in accordance with a. determination that the user voice does not correspond to the known user.

36. A non-transitory computer-readable storage medium, storing one or more programs for execution by one or more processors of an electronic device, the one or more programs including instructions for:

determining whether a signal-to-noise ratio of a first audio signal obtained while a voice-related feature of the electronic device is in use exceeds a threshold;

in accordance with a determination that the signal-to-noise ratio exceeds the threshold, obtaining a user voice sample from the first audio signal;

determining a user voice profile based at least in part on the user voice sample;

determining user-specific noise suppression parameters based at least in part on the user voice profile;

obtaining a second audio signal that includes a user voice and ambient sounds; and applying noise suppression to the second audio signal based at least in part on the user-specific noise suppression parameters to suppress the ambient sounds of the second audio signal.

37. The non-transitory computer-readable storage medium of claim 36, wherein the one or more programs further include instructions for:

determining the user voice profile further based at least in part on another user voice sample obtained during an activation period of the electronic device.

38. The non-transitory computer-readable storage medium of claim 36, wherein the one or more programs further include instructions for:

determining whether the user voice corresponds to a known user and, when the user voice corresponds to the known user, recalling the user voice profile associated with the user voice.

39. The non-transitory computer-readable storage medium of claim 36, wherein the one or more programs further include instructions for:

determining whether the user voice corresponds to a known user, wherein determining whether the signal-to-noise ratio of the first audio signal obtained while the voice-related feature of the electronic device is in use exceeds the threshold is performed in accordance with a determination that the user voice does not correspond to the known user.

* * * * *